US008802956B2

(12) United States Patent
Kira et al.

(10) Patent No.: US 8,802,956 B2
(45) Date of Patent: Aug. 12, 2014

(54) AUTOMATIC ACCOMPANIMENT APPARATUS FOR ELECTRONIC KEYBOARD MUSICAL INSTRUMENT AND FRACTIONAL CHORD DETERMINATION APPARATUS USED IN THE SAME

(71) Applicant: Kabushiki Kaisha Kawai Gakki Seisakusho, Hamamatsu (JP)

(72) Inventors: Yoshifumi Kira, Shizuoka (JP); Kiyomi Kurebayashi, Shizuoka (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 0 days.

(21) Appl. No.: 13/890,526

(22) Filed: May 9, 2013

(65) Prior Publication Data

US 2013/0298750 A1 Nov. 14, 2013

(30) Foreign Application Priority Data

May 10, 2012 (JP) ..... 2012-108818
May 21, 2012 (JP) ..... 2012-115924

(51) Int. Cl.
*G10H 1/38* (2006.01)
*G10H 7/00* (2006.01)

(52) U.S. Cl.
USPC ..... 84/637

(58) Field of Classification Search
USPC ..... 84/637, 613, 669
See application file for complete search history.

(56) References Cited

U.S. PATENT DOCUMENTS

| | | | | |
|---|---|---|---|---|
| 5,260,510 | A * | 11/1993 | Shibukawa | 84/637 |
| 6,380,475 | B1 * | 4/2002 | Kira | 84/637 |
| 6,777,606 | B2 * | 8/2004 | Kira | 84/613 |
| 8,373,055 | B2 * | 2/2013 | Kira | 84/622 |
| 2002/0023531 | A1 * | 2/2002 | Kira | 84/637 |

FOREIGN PATENT DOCUMENTS

| | | | |
|---|---|---|---|
| JP | 03-117928 | U | 12/1991 |
| JP | 04-030197 | A | 2/1992 |
| JP | 04-59895 | U | 5/1992 |
| JP | 07-114381 | A | 5/1995 |
| JP | 07-121172 | A | 5/1995 |
| JP | 07-121176 | A | 5/1995 |
| JP | 3307742 | B2 | 5/1995 |
| JP | 3543124 | B2 | 6/1996 |

* cited by examiner

*Primary Examiner* — Jeffrey Donels
(74) *Attorney, Agent, or Firm* — Sughrue Mion, PLLC

(57) ABSTRACT

The number of chords belonging to a first chord group is decreased to less than the number of chords belonging to a second chord group. In a first detection mode, when a first determining unit determines that a state of key depressed does not correspond to any chord in a first chord group, a previously selected chord is continuously determined. Accordingly, even if a chord detection is performed on a change of melody point by point, the number of chords substantially detected is decreased. This decreases the number of changes in accompaniment, thus stabilizing a playback of the accompaniment.

8 Claims, 22 Drawing Sheets

FIG. 22

| MELODY | G4 | A4 | B4 | C5 | D5 |
|---|---|---|---|---|---|
| CHORD DETECTION (1) | CM7 | CM7(13) | CM7 | CM7 | CM9 |
| ACCOMPANIMENT CHANGE | | YES | YES | | YES |
| CHORD DETECTION (2) | CM7 | CM7 | CM7 | CM7 | CM9 |
| ACCOMPANIMENT CHANGE | | | | | YES |

AUTOMATIC ACCOMPANIMENT APPARATUS FOR ELECTRONIC KEYBOARD MUSICAL INSTRUMENT AND FRACTIONAL CHORD DETERMINATION APPARATUS USED IN THE SAME

BACKGROUND OF THE INVENTION

1. Field of the Invention

The present invention relates to an automatic accompaniment apparatus for an electronic keyboard musical instrument to detect accompaniment contents associated with an operation of the keyboard and to automatically accompany and relates to a fractional chord determination apparatus used in the same.

2. Discussion of Background

As a kind of electronic keyboard musical instrument including an automatic accompaniment function, an electronic keyboard musical instrument where a keyboard portion is divided into a key region for chord detection and a key region for normal performance is known. With this instrument, accompaniment sounds are automatically generated by performing cord detection corresponding to a key operation of the key region for chord detection (region for performing an accompaniment), on the other hand, ordinary music tones (melody tones) are generated corresponding to the key operation of the key region for normal performance (region for performing a melody playing).

Specifically, the generation of the accompaniment sounds in the electronic keyboard musical instrument is performed as follows. That is, at first, the chord detection is performed with a pattern of depressing a key in the chord detection key region. Then, in the chord detection, the chords (including chord root and chord type) corresponding to the depressed pattern of the keys are detected. Next, the preliminarily stored automatic accompaniment pattern data is retrieved from the storing unit, and deployed by a chord deployment operation. The accompaniment pattern data corresponding to the detected chords is generated for the accompaniment sounds by sending the deployed data to a sound source.

In the electronic keyboard musical instrument, a chord detection method is used that is capable of selecting a mode to determine a chord at the point when a single key is depressed (one finger mode described below), and a mode to be determined from a chord when 3 or more keys are depressed, and the like. Furthermore, of this latter chord detection method, a chord change is performed in a fingered when a chord detection of 3 or more keys are depressed on a low-pitched sound side of the keyboard at the split point; in a full keyboard mode, the chord change is performed when the chord detection of 3 or more keys are depressed on the whole keyboard.

In the case where a fractional chord detection mode switch is provided for setting to the fractional chord detection mode, the lowest-pitched sound of the depressed key is detected as a bass. In the fractional chord such as "C/B", the numerator chord is a high part of the note (chord part) and the denominator chord is a low part of the note (bass part).

Among the modes where a chord is determined by depressing the key chord of 3 or more keys, there is a mode that changes only the denominator chord (the following describes the denominator chord as a bass root) while the numerator chord is fixed when 2 or fewer keys are depressed. The bass root can be specified freely.

However, in general, with keyboard musical instruments, especially in the piano, the left hand is assumed to play a bass line and a chord, and the right hand is assumed to play a melody, a counter line, and the like, in the aforementioned full keyboard mode. The chord is detected point by point with respect to the movement of the melody, and the accompaniment is changed corresponding to the chord detection. This leads to a problem that does not allow a musical performance intended by a performer.

SUMMARY OF THE INVENTION

The present invention was conceived in view of the situation above, and it is an object to provide an automatic accompaniment apparatus for an electronic keyboard musical instrument that can prevent an unnecessary accompaniment change caused by point by point chord detection of melody flow even in a mode such as the above-mentioned full keyboard mode in which a chord where 3 or more keys are depressed on the whole keyboard is detected and a chord change is performed.

On the other hand, in the above-mentioned configuration with fractional chord detection mode switch, it is necessary to set the mode switch ON or OFF in advance. If the mode switch is changed while playing, the chord detection method changes between detecting the fractional chord or not, this results in unnatural performance.

It is preferable that the player not be aware of the condition of the ON/OFF of the switch (switching of mode and parameter setting) that the automatic accompaniment is capable of reflecting a fractional chord performance.

The present invention was conceived in view of the above-mentioned problems, and proposes a fractional chord determination apparatus that can reflect a fractional chord performance by an automatic accompaniment without the player being aware of the ON/OFF condition of the fractional chord detection mode switch (switching of mode and parameter setting).

A configuration of an automatic accompaniment apparatus for an electronic keyboard musical instrument according to a first aspect of the present invention has the following basic feature. The automatic accompaniment apparatus is used for an electronic keyboard musical instrument for performing chord detection based on a state of a key depressed in a region combining at least an accompaniment region and a melody playing region in a keyboard with a plurality of keys, so as to perform automatic accompaniment based on a detected chord. The automatic accompaniment apparatus includes setting unit, first determining unit, first selecting unit, second determining unit, and automatic accompaniment unit. The setting unit sets a detection mode by switching between a first detection mode and a second detection mode. The first detection mode sets a whole region combining the accompaniment region and the melody playing region to a detected object of the chord detection. The second detection mode sets a part of the accompaniment region to a detected object of the chord detection. The first determining unit determines whether or not a state of a key depressed in a region set to the detected object corresponds to any chord in a first chord group in a case where the first detection mode is set by the setting unit. The first selecting unit selects a corresponding chord in the first chord group in a case where the first determining unit determines that the state of the key depressed corresponds to one chord in the first chord group. The second determining unit determines whether or not the state of the key depressed in the region set to the detected object corresponds to any chord in a second chord group in a case where the second detection mode is set by the setting unit. The second selecting unit selects a corresponding chord in the second chord group in a case where the second determining unit determines that the state of the key depressed corresponds to one chord in the second chord group. The automatic accompaniment unit performs automatic accompaniment based on a chord selected by the first selecting unit or the second selecting unit. In a case where the number of chords belonging to the first chord group is set to be fewer than the number of chords belonging to the second chord group, and the setting unit sets the first detection mode, a previously selected chord is continuously determined when the first determining unit determines that the state of the key depressed is not any chord in the first chord group.

With the above-described configuration, the number of chords belonging to the first chord group is decreased to less than the number of chords belonging to the second chord group. In the case of the first detection mode, when the first determining unit determines that it is not any of the first chord group, the first determining unit determines it as the previously selected chord. Even if the chord detection is performed point by point with respect to the movement of the melody, as described above, the number of chords which is actually detected is reduced. Therefore, the number of accompaniment changes decreases, and the accompaniment playback is stabilized.

In the above-described configuration, the automatic accompaniment apparatus for the electronic keyboard musical instrument is preferred to be configured as follows. The first determining unit determines the second chord group and selects a corresponding chord in the second chord group. The automatic accompaniment apparatus further includes a discarding unit for discarding a result of the selection in a case where the selected chord is not included in the first chord group.

In the first detection mode, the discarding unit (such as chord filter) discards a chord that should not be determined. That is, by not having a chord, the number of chords which is actually detected is reduced, and the number of accompaniment changes decreases. Therefore, the accompaniment playback is stabilized.

The automatic accompaniment apparatus for the electronic keyboard musical instrument is preferred to be configured as follows. In a case where the first selecting unit or the second selecting unit does not select any chord, the automatic accompaniment continues based on a last chord selected. As a result, the accompaniment playback is further stabilized.

On the other hand, a configuration of a fractional chord determination apparatus according to a second aspect of the present invention has the following basic feature. The fractional chord determination apparatus is used for determining a fractional chord corresponding to a depressed key, by setting a first region to detect a bass root of the fractional chord on a keyboard with a plurality of keys and a second region to detect a chord with a root that is different from the bass root on the keyboard, so as to determine the fractional chord by detecting the bass root and the chord corresponding to a state of a key depressed in each region. The fractional chord determination apparatus includes first setting unit, determining unit, second setting unit, and control unit. The first setting unit sets the first region corresponding to a lowest-pitched sound by a key depressed on the keyboard with a plurality of keys. The determining unit determines whether the fractional chord is to be determined corresponding to the number of keys depressed in the first region. The second setting unit sets a region between: a lower limit sound set corresponding to a lowest-pitched sound by the key depressed on the keyboard; and an upper limit sound set corresponding to a lowest-pitched sound by the key depressed on a keyboard of a higher sound than a sound in the first region, to the second region when the determining unit determines that the fractional chord is determined. The control unit for respectively determines: a bass root based on the state of the key depressed in the first region, and a chord with a root that is different from the bass root based on the state of the key depressed in the second region, and performs automatic accompaniment corresponding to the fractional chord.

With the above-described configuration, the determining unit determines whether or not the fractional chord is to be determined corresponding to the number of depressed keyboard in the first detection region. When the determining unit has determined that the fractional chord is to be determined, the second setting unit sets the second region between: the lower limit sound corresponding to the lowest-pitched sound of the depressed keys on the keyboard, and the upper limit sound corresponding to the lowest-pitched sound of the depressed keys on the keyboard for the higher pitched sound compared with the first region. Also, the control unit determines the bass root by the state of the depressed keys in the first region, and each chord root, which is different from the bass root, by the state of the depressed keys in the second region, thus the fractional chord is automatically detected. As a result, the fractional chord determination apparatus is configured to enable automatic accompaniment corresponding to the fractional chord.

The following configuration is a configuration further specifying the above-described configuration. Specifically, a fractional chord determination apparatus is used for determining a fractional chord corresponding to a depressed key, by setting a first region to detect a bass root of the fractional chord on a keyboard with a plurality of keys and a second region to detect a chord with a root that is different from the bass root on the keyboard, so as to determine the fractional chord by detecting the bass root and the chord corresponding to a state of a key depressed in each region. The fractional chord determination apparatus includes first setting unit, determining unit, second setting unit, and control unit. The first setting unit sets the first region corresponding to a lowest-pitched sound by a key depressed on the keyboard to a sound between the lowest-pitched sound and a sound higher than the lowest-pitched sound by a pitch corresponding to N1 key shown in the following formula 1. The determining unit determines that the fractional chord is to be determined in a case where the number of depressions on the keyboard in the first region is equal to or less than two, and determines that the fractional chord is not determined in a case where the number of depressions is equal to or more than three. The second setting unit sets a region between: a lower limit sound that is a sound higher than the lowest-pitched sound by a pitch corresponding to the N2 key shown in the following formula 2; and an upper limit sound that is a sound higher than the lowest-pitched sound upon a key depressed on a keyboard of a higher sound than a sound in the first region by a pitch corresponding to the N3 key shown in the following formula 3, to the second region when the determining unit determines that the fractional chord is to be determined. The control unit respectively determines: a bass root based on a state of depressed key in the first region, and a chord with a root that is different from the bass root based on a state of key depressed in the second region, and for performing automatic accompaniment corresponding to the fractional chord.

$$1<N1 \quad \text{(Formula 1)}$$

$$1<N2 \quad \text{(Formula 2)}$$

$$1<N3 \quad \text{(Formula 3)}$$

In the above-described the configuration, the first setting unit sets the first region to the sound between the lowest-pitched sound and the sound higher than the lowest-pitched sound by a pitch corresponding to N1 key. The determining unit determines whether or not the fractional chord is to be determined. In the case where the number of keys depressed on the keyboard is equal to or less than two in the first region, the fractional chord is to be determined. On the other hand, in the case where the number of keys depressed on the keyboard is equal to or more than three, the fractional chord is not to be determined. Furthermore, in the case where the fractional chord is to be determined, regarding the second region set by the second setting unit, the determining unit sets the region between the lower limit sound and the upper limit sound to the second region. The lower limit sound is a higher sound by a pitch corresponding to the N2 keys from the lowest-pitched sound of the key depressed on the keyboard. The upper limit sound is a higher sound by a pitch corresponding to the N3 keys from the lowest-pitched sound of the key depressed on the keyboard for a higher pitched sound compared with the first region.

Both the above-described configurations are preferred to be configured as follows. The control unit determines a pitch name corresponding to the depressed key in the first region, which is a pitch name of the key depressed, as the bass root in the case where the last depressed key is in a predetermined sound range from a lowest-pitched sound by the key depressed on the keyboard toward an upper side, and the control unit determines a pitch name of the lowest-pitched sound as the bass root in the case where the key depressed is out of the range.

In the case where the bass key depression on the bass root side has been played in the legato, the pitch name of the last depressed key in the legato is determined to the bass root. Thus, also in the case where the keyboard on the upper side from the lowest-pitched sound has been depressed, the configuration enables to determine the bass root before releasing the keyboard on the lowest-pitched sound and to change the bass root to the timing which the performer desires more. Furthermore, when the key depressed later has been outside the range, the pitch name of the lowest-pitched sound is determined to the bass root, and the configuration enables to extend the chord detection range of another chord detection region of the fractional chord. That is, if the finger which is playing the another chord side approaches the bass root side, it is possible to be erroneously determined to a part of the chord on the bass root side, thus the bass root has been determined not the pitch name of the last depressed key in the legato on the bass root side but the pitch name of the lowest-pitched sound. As a result, even if another chord detection region of the fractional chord approaches the bass root side, the configuration can eliminate the erroneous determination. Here, the pitch name of the key depressed of the lowest-pitched sound may coincide with the pitch name of the last depressed key.

Any of these configurations are preferred to be configured as follows. In a case where the determining unit determines that the fractional chord is not determined, the control unit sets a third region between the lowest-pitched sound and a sound higher than the lowest-pitched sound by a pitch corresponding to the N4 key shown in the following formula 4 and determines a chord that is not a fractional chord as a chord for performing the automatic accompaniment corresponding to a state of keys depressed in the third region.

$$N1 \leq N4 \qquad \text{(Formula 4)}$$

Since it is not determined to be the fractional chord, ordinary chord detection is performed in the third region. The automatic accompaniment is performed corresponding to the detected chord.

Additionally, other than the above-described configuration where it is not determined to be the fractional chord, any other configurations are preferred to be configured as follows. In a case where a chord detection based on a state of a key depressed in the second region results in a root of this chord that coincides with the bass root, fractional chord determination is stopped and the chord detected based on the state of key depressed in the second region is determined for performing the automatic accompaniment.

This specifies a configuration to exit the fractional chord mode, and is similar to the above-described configuration where it is not determined to be the fractional chord.

Advantageous Effects of Invention

According to the configuration of the automatic accompaniment apparatus of the electronic keyboard musical instrument according to the first invention, the number of chords belonging to the first chord group is reduced to less than the number of chords belonging to the second chord group. In the case of the first detection mode, when the first determining unit has determined not to be included in one of the first chord group, since the determining unit determines as the previously selected chord, even if the chord detection is performed point by point with respect to the movement of the melody, as described above, the number of chords which is virtually detected is reduced. Therefore, the number of accompaniment changes decreases, and the configuration has a considerably beneficial effect on stabilizing the accompaniment playback.

With the above-described configuration of the fractional chord determination apparatus according to the second aspect of the present invention, whether or not the fractional chord is to be determined corresponding to the number of depressed key in the first detection region is determined by the determining unit. When the determining unit has determined that the fractional chord is to be determined, the second region is set by the second setting unit between the lower limit sound set corresponding to the depressed keys of the lowest-pitched sound on the keyboard and the upper limit sound set corresponding to the depressed keys of the lowest-pitched sound among the depressed keys on the keyboard for the higher pitched sound compared with the bass detection region. Also, the bass root is determined by the state of the depressed keys in the first region by using the control unit, and each chord root which is different from the bass root is determined by the state of the depressed keys in the second region, thus the fractional chord is automatically detected. The fractional chord determination apparatus is configured to enable automatic accompaniment that corresponds to the fractional chord as a beneficial effect.

Additionally, regarding the bass root, the pitch name corresponding to the depressed key in the first region, and within the range of the predetermined sound on the upper side from the depressed key of the lowest-pitched sound on the keyboard, the pitch name of the last depressed key is determined to be the bass root. According to this configuration, in the case where the bass key depression on the bass root side has been played on the legato side, the pitch name of the last depressed key in the legato is determined to the bass root. Thus, also in the case where the keyboard on the upper side from the lowest-pitched sound has been depressed, the configuration enables to determine the bass root before releasing the keyboard on the lowest-pitched sound and to change the bass root to the timing which the performer desires more. Furthermore, when the key depressed later has been outside the range, the pitch name of the lowest-pitched sound is determined to the bass root, and the configuration enables to extend the chord detection range of another chord detection region of the fractional chord. That is, if the finger which is playing the another chord side approaches the bass root side, it is possible to be erroneously determined to a part of the chord on the bass root side. However, regarding in the case where the key depressed later has been outside the range, the pitch name of the lowest-pitched sound has been determined to the bass root. Thus, even if the chord detection range of another chord detection region of the fractional chord approaches the bass root side, the configuration has an advantage of eliminating the erroneous determination.

Furthermore, when the determining unit has determined not to set the fractional chord, the control unit set the third region to the sound between the lowest-pitched sound and the sound higher than the lowest-pitched sound by a pitch corresponding to the N4 key. The chord is not the fractional chord corresponding to the state of key depressed key in the third region and the configuration is made to determine to the chord performing the automatic accompaniment. Therefore, also in the configuration of the fractional chord determination apparatus, since the determination to the fractional chord is not made, the normal chord detection is executed in the third region, and the automatic accompaniment is performed corresponding to the chord.

Additionally, by being configured to exit the fractional chord mode, conversely, the configuration enables an exit mode after the fractional chord has been determined. After that, the normal chord detection is performed in the third region, the automatic accompaniment is performed to be corresponding to the chord.

BRIEF DESCRIPTION OF THE DRAWINGS

FIG. 22 is an explanatory diagram showing an example in the case where whether or not the number of detected chords is reduced when first detection mode is performed.

DETAILED DESCRIPTION OF THE PREFERRED EMBODIMENTS

Figure 1:
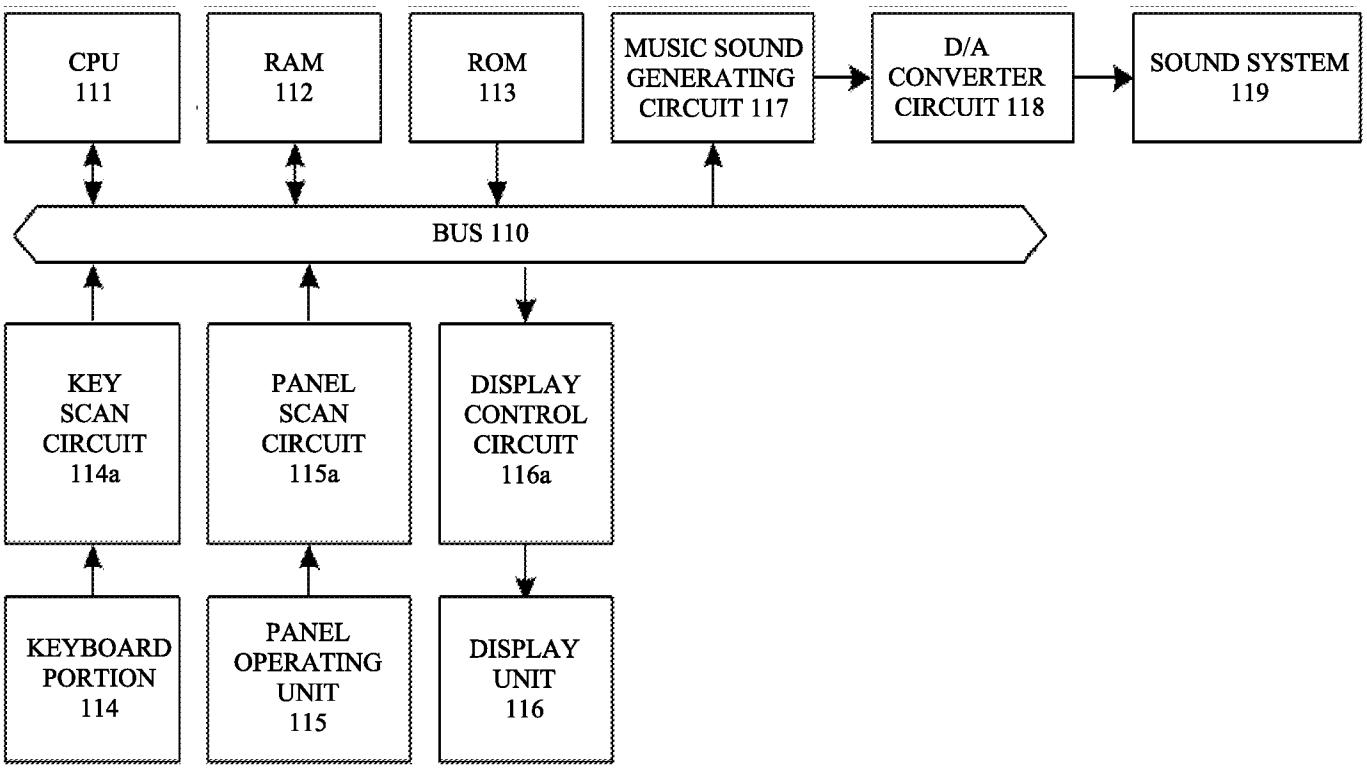
FIG. 1 is a basic circuit diagram of an electronic keyboard musical instrument including a configuration of a fractional chord determination apparatus configured with an automatic accompaniment apparatus according to one embodiment of the present invention.

Embodiments of the present invention will be described hereinafter. FIG. 1 is a basic circuit diagram of an electronic keyboard musical instrument including a configuration of a fractional chord determination apparatus according to one embodiment of the present invention.

As shown in FIG. 1, the electronic musical instrument includes a system bus 110 that connects to a CPU (Central Processing Unit) 111, a RAM (Random Access Memory) 112, a ROM (Read Only Memory) 113, a keyboard portion 114, which connects via a key scan circuit 114*a*, a panel operating unit 115, which connects via a panel scan circuit 115*a*, a display unit 116, which connects via a display control circuit 116*a*, and a music sound generating circuit 117 which is capable of generating 64 channels of sounds simultaneously by a sound source, respectively. Various commands and data are received and transmitted to these devices through the system bus 110. Also, a D/A converter circuit 118, which converts the generated music sounds from a digital to analog, and a sound system 119 such as an amplifier amplifying the music sounds and a speaker generating sounds outside are electrically connected to the output side of the music sound generating circuit 117.

The CPU 111 controls each unit of the electronic keyboard musical instrument including the configuration of the present invention depending on a control program being stored in the program memory storage unit of the ROM 113 (a first setting portion 1, a determiner 2, a second setting portion 3, a controller 4, a setting unit 5, a first determining unit 6, a first selecting unit 7, a second determining unit 8, a second selecting unit 9, an automatic accompaniment portion 10, and the like described below are configured to consist of the controls). Also, the CPU 111 executes an application program stored in the program memory storage unit, and as necessary, uses a RAM 112 as an operation region. Furthermore, the CPU 111 is configured to process data while using various types of fixed data stored in the ROM 113.

The RAM 112 stores status information of the unit and is used as an operation region of the CPU 111. In addition, various registers and flags and the like for controlling the electronic keyboard musical instrument are defined in the RAM 112, and the RAM 112 can be accessed via the system bus 110 by the CPU 111.

The ROM 113, as described above, not only stores the program to control the electronic keyboard musical instrument as a whole, but also stores various types of fixed data (including each chord data for an accompaniment shown in FIGS. 4 and 5 described below having a fractional chord) used by the CPU 111.

Furthermore, a removable flash memory (not shown) which can connect via an interface (not shown) disposed in the system bus 110 of the electronic keyboard musical instrument may be used as part of the ROM 113 and the RAM 112 as necessary.

The keyboard portion 114 consists of a keyboard of an electronic keyboard musical instrument. The keyboard portion 114 includes a plurality of keyboards where a keyboard switch is opened and closed in conjunction with the depression and release of the keys. A key scan circuit 114*a*, which is interposed between the keyboard portion 114 and the system bus 110, examines a state of the keyboard switch, and generates the signals indicating key-ON/key-OFF and the touch data showing the strengths (speed) of the keyboard touch from the signals. Also, the key scan circuit 114*a* outputs the information of the key-ON/key-OFF signals and the keyboard number. The information of the key-ON/key-OFF signals and the keyboard number as well as the touch data are sent to the CPU 111 via the system bus 110 as the key depression data (manual key). The key depression data detected by the keyboard portion 114 and the key scan circuit 114*a* are input into each setting portion 1 and 3, the first determining unit 6, and a second determining unit 8 described below.

The panel operating unit 115 includes various switches such as a power switch and a tone color selecting switch, a mode selecting touch panel, a variable volume unit, and the like. The panel scan circuit 115*a*, which is interposed between the panel operating unit 115 and the system bus 110, examines the set/reset state of each switch and touch panel disposed in the panel operating unit 115. The panel scan circuit 115*a* detects and transmits data where the panel switch data is in the ON state to the CPU 111.

The display unit 116 is connected to the system bus 110 via the display control circuit 116*a*, and has a configuration where the CPU 111 controls the indication of various operational states in the panel operating unit 115, the operating state of the electronic keyboard musical instrument, and the like shown in FIG. 3 described below.

Figure 2:
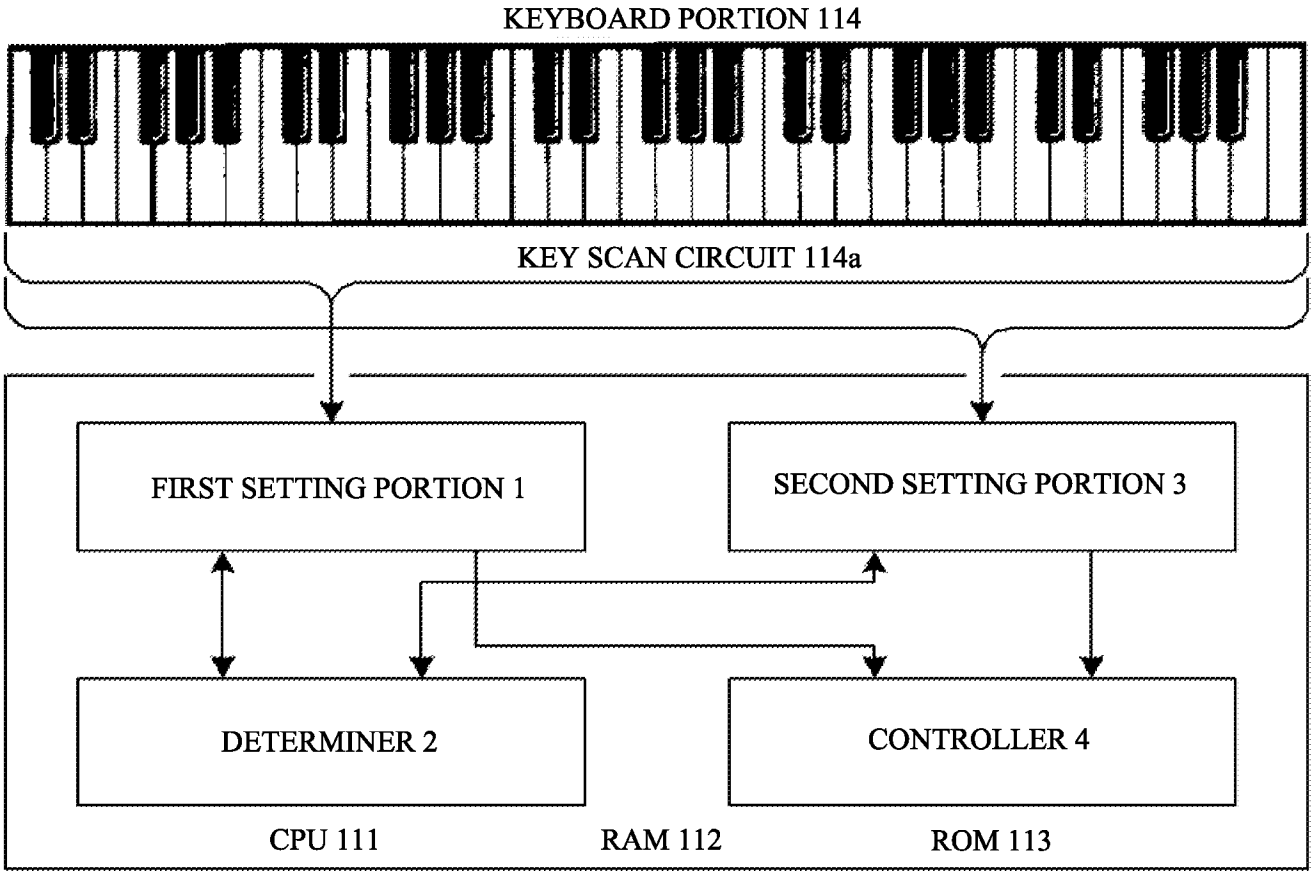
FIG. 2 is a functional block diagram of a fractional chord determination configuration used when automatic accompaniment is performed by the electronic keyboard musical instrument.

FIG. 2 is a functional block diagram of a fractional chord determination configuration according to the present invention used when automatic accompaniment is executed by the electronic keyboard musical instrument.

The configuration is provided to form a part of the function in the electronic keyboard musical instrument and determines the fractional chord corresponding to the key depression. In a keyboard with a plurality of keys, setting a first region for detecting a bass root of the fractional chord and a second region for detecting a chord including a different root from the bass root in the keyboard, the fractional chord determination apparatus is configured to determine the fractional chord by detecting the bass root and the chord corresponding to the state of keys depressed in each region.

Then, the configuration includes the first setting portion 1, the determiner 2, the second setting portion 3, and the controller 4. Corresponding to the lowest-pitched sound of the key depression on the keyboard among the plurality of keys, the first setting portion 1 sets the first region (bass detection region) to from the lowest-pitched sound to a higher sound than the lowest-pitched sound by a pitch corresponding to N1 key shown in the following formula 5 (N1=15 keys, the purpose is described in the following. In the case where the number of key depressions on the keyboard is equal to or more than three in the first region, the chord from the lowest-pitched sound is assumed to be in the first degree to 9th and is determined without the determination of the fractional chord. In contrast, when B is played for a lower octave, during playing of B-D-G (G chord III-V-I), a D sound (fifth degree sound of G chord) is set to be excluded in the first region. The number of key depressions on the keyboard is set to be 2 or fewer keys in the first region to form the fractional chord). The determiner 2 determines that the fractional chord is to be determined in the case where the number of key depressions on the keyboard is equal to or less than two in the first region (a bass detection region). Additionally, the determiner 2 determines that the fractional chord is not selected in the case where the number of key depressions is equal to or more than three. The second setting portion 3 sets a region between a lower limit sound and an upper limit sound to the second region (a chord detection region) in the case where the determiner 2 determines that the fractional chord is selected. The lower limit sound is a higher sound by a pitch corresponding to N2 keys (=7 keys) shown in the following formula 6 from the lowest-pitched sound of the key depression on the keyboard. The upper limit sound is a higher sound by a pitch corresponding to N3 keys (17 keys from the lowest-pitched sound assumed to be the first degree among the key depressions on the keyboard for a higher pitched sound compared with the bass detection region up to the third degree (10th) for an higher octave). This is shown in the following formula 7 from the lowest-pitched sound among the key depressions on the keyboard for a higher-pitched sound compared with the first region (bass detection region). The controller 4 determines a bass root and a chord including a different root from the bass root in the case where the fractional chord is a determiner 2. The bass root is determined depending on a state of key depressed in the first region (the bass detection region) while the chord is determined depending on a state of key depressed in the second region (the chord detection region). Subsequently, the controller 4 performs the automatic accompaniment corresponding to this fractional chord.

$$1<N1 \quad \text{(Formula 5)}$$

$$1<N2 \quad \text{(Formula 6)}$$

$$1<N3 \quad \text{(Formula 7)}$$

The first and second setting portions 1 and 3 are configured with the CPU 111 loaded with the program, which is read from the ROM 113, to implement the present invention, and the determiner 2 and the controller 4 are also configured with the CPU 111 loaded with the same program. The first and second setting portions 1 and 3 receive the key depression data, which are input from the key scan circuit 114*a* via the system bus 110.

Figure 3:
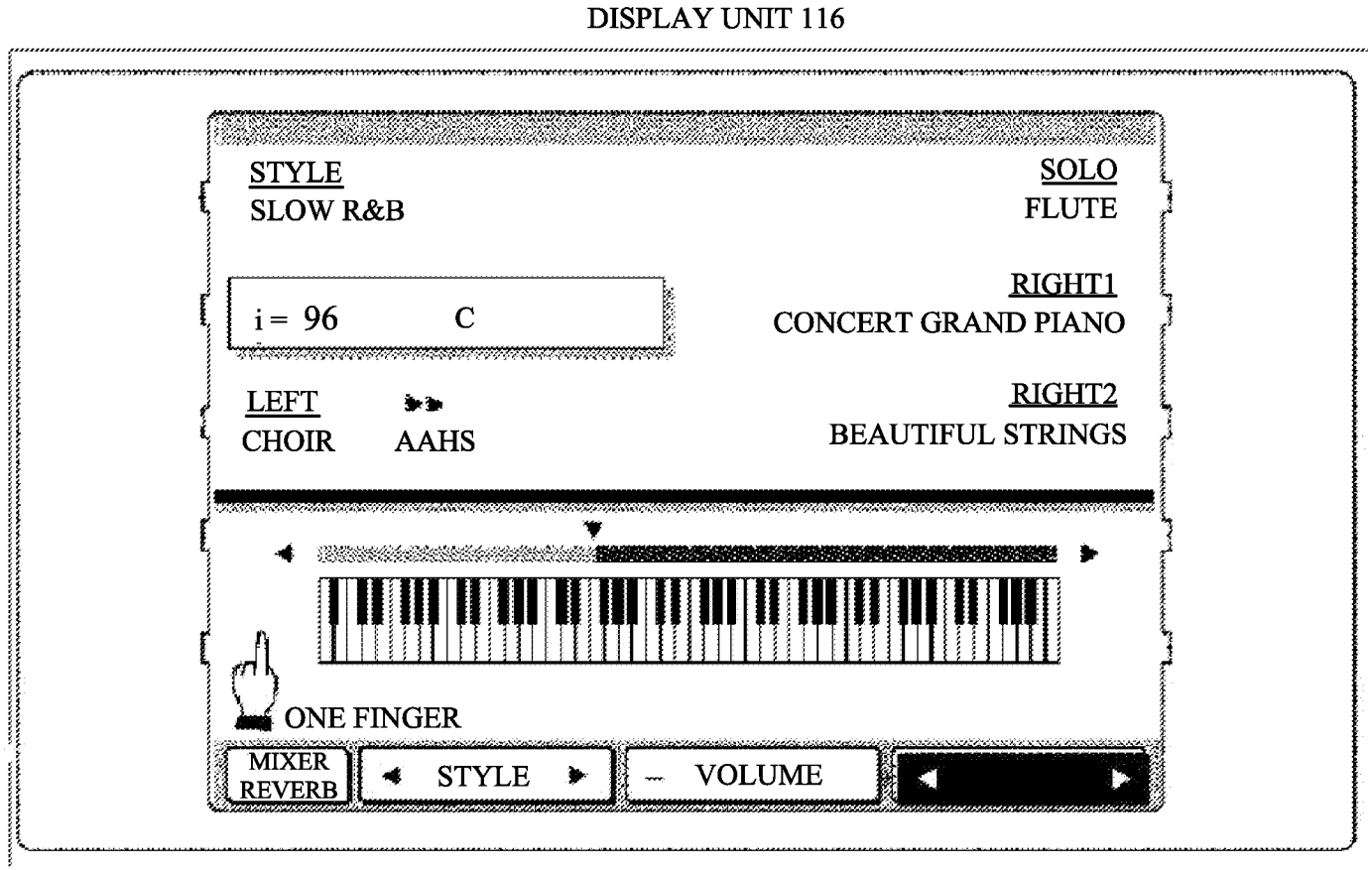
FIG. 3 is a screen configuration diagram showing a display state on a display unit 116.

FIG. 3 is an explanatory diagram showing a display example of the display unit 116. In the keyboard musical instrument, the keyboard portion 114 is automatically divided into 2 parts, and the keyboard musical instrument is in a split state. It is possible to configure that the chord changes can be performed on the low-pitched sound side of the keyboard at the split point and the keyboard to play the melody with the high-pitched sound side by synchronizing the accompaniment. In addition, in the case where the automatic accompaniment is ON, the whole key chords are detected; however, the details will be described below. Furthermore, as show in FIG. 3, the illustration of the keyboard portion 114 is displayed on the display unit 116, and the reverse triangle is marked to the position of the split point. The "chord detection method" is displayed on the left below of the display unit 116.

When the automatic accompaniment is ON, the chord changes are performed on the low-pitched sound side of the keyboard. The chord detection method has 3 methods as follows, and additionally, the ON/OFF condition of the fractional chord is automatically determined by the configuration.

a) One Finger (A) Chord detection keyboard: chord change is performed on the low-pitched sound side of the keyboard from the split point.

(B) Detection condition: major chord is detected only by depressing 1 key, and minor chord/7th chord is detected only by depressing 2 keys.

b) Fingered (A) Chord detection keyboard: chord change is performed on the low-pitched sound side of the keyboard from the split point.

(B) Detection condition: chord detection is performed when 3 or more keys are depressed.

c) Full Keyboard (A) Chord detection keyboard: chord change is performed on the whole keyboard.

(B) Detection condition: chord detection is performed when 3 or more keys are depressed.

Figure 4:
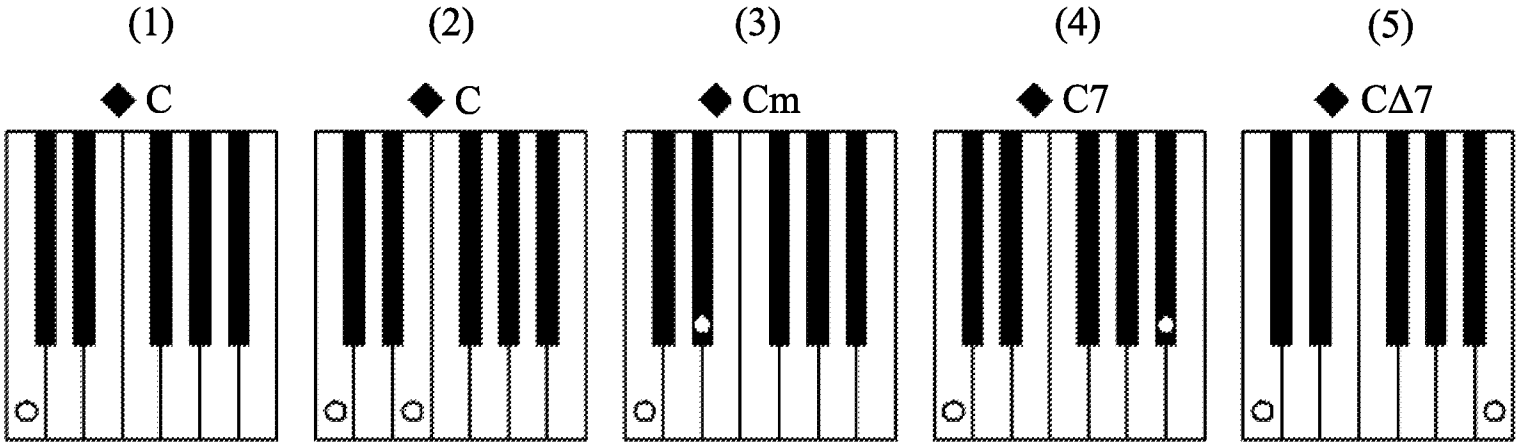
FIG. 4 is an explanatory diagram showing an example of data in the case where a chord root for one finger is C.
Figure 5:
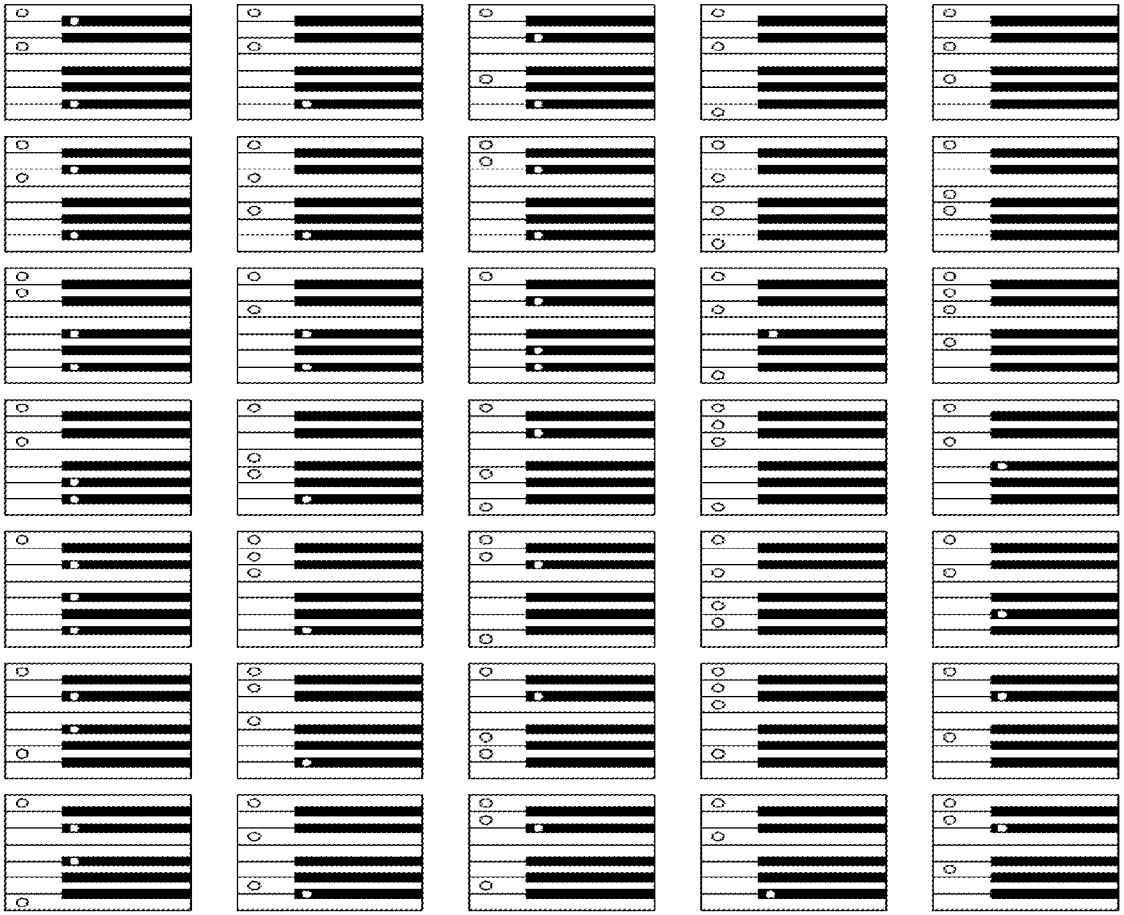
FIG. 5 is an explanatory diagram showing an example of data in the case where the chord root is C for a fingered and a full keyboard.

The ROM 113 stores the chord form data for respective chord detections, and FIG. 4 shows an example of data in the case of where the chord root for the one finger is C. In addition, FIG. 5 illustrates an example of data in the case of where the chord root for the fingered and the full keyboard is C.

When comparing the one finger and fingered where one hand is assumed to be detected, the full keyboard where both hands are assumed to be detected varies the chord form much complicatedly. Therefore, the full keyboard is configured to reduce the type of detected chord.

Figure 6:
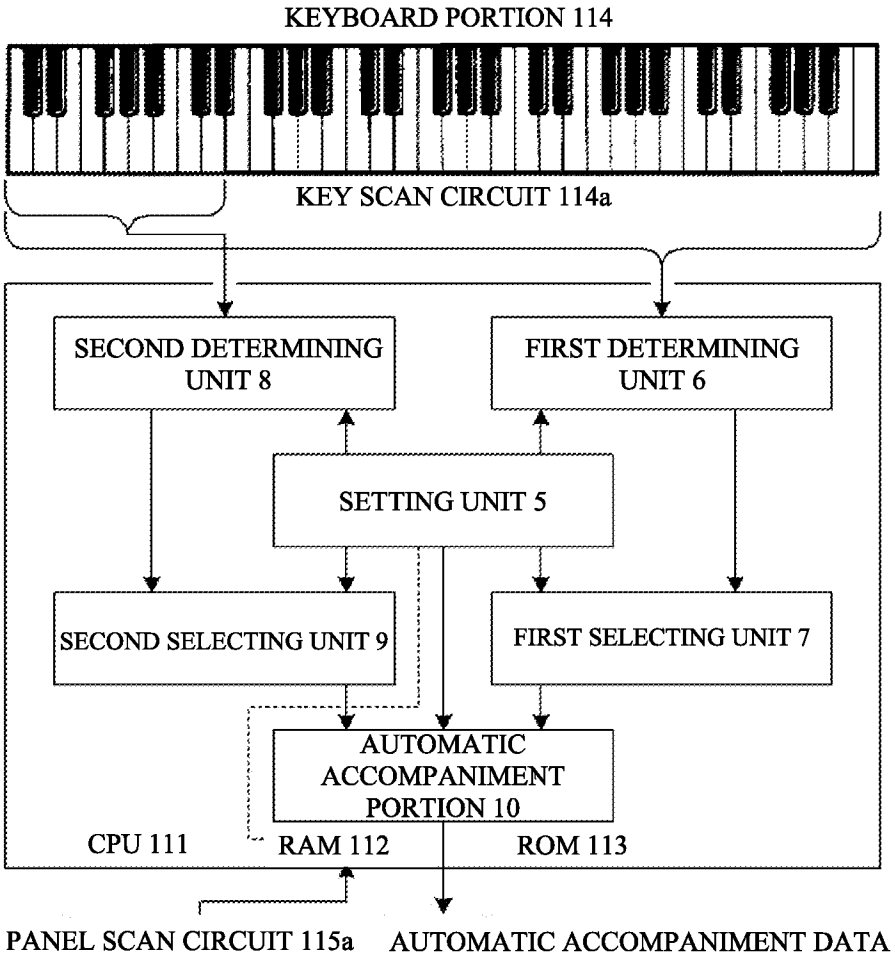
FIG. 6 is a functional block diagram of the automatic accompaniment apparatus configured according to the configuration of this embodiment.

That is, in the configuration of this the embodiment, as shown in FIG. 6, the chord detection is performed based on the state of key depressed in a region combined with the at least an accompaniment region and a melody playing region in the keyboard portion 114 having a plurality of keys. An automatic accompaniment apparatus of the electronic keyboard musical instrument performs automatic accompaniment based on the detected chord. This sets the whole region combined with the accompaniment region and the melody playing region to a first detection mode (full keyboard mode). A part of the region for accompaniment is set to a second detection mode (one finger mode or fingered mode) as a detected object of the chord detection. The automatic accompaniment apparatus of the electronic keyboard musical instrument includes the setting unit 5, the first determining unit 6, the first selecting unit 7, the second determining unit 8, the second selecting unit 9, and the automatic accompaniment portion 10. The setting unit 5 (corresponding to the setting unit of the present invention) switches the detection modes. In the case where the first detection mode (full keyboard mode) is set by the setting unit 5, the first determining unit 6 (corresponding to the first determining unit of the present invention) determines whether or not the state of key depressed in the region of the detected object corresponds to any chord in the first chord group. The first selecting unit 7 (corresponding to the first selecting unit of the present invention) selects the chord corresponding to one of the first chord group when the first determining unit 6 determines which of the first chord group. In the case where the second detection mode (one finger mode or fingered mode) is set by the setting unit 5, the second determining unit 8 (corresponding to the second determining unit of the present invention) determines whether or not the state of key depressed in the region of the detected object corresponds to any chord in the second chord group. When the second determining unit 8 has determined which of the second chord group, the second selecting unit 9 (corresponding to the second selecting unit of the present invention) selects the chord corresponding to one of the second chord group. The automatic accompaniment portion 10 (corresponding to the automatic accompaniment unit of the present invention) performs the automatic accompaniment based on the chord selected by the first or the second selecting unit 7 or 9.

Then, in the configuration, the number of chords belonging to the first chord group (basic chord: C, CM7, C6, Cm, Cm6, Cm6, Cm7, and so on) is configured to be stored and set with the lower state compared with the number of chords belonging to the second chord group (tension chord other than the basic chord). Also, when the number of chords is set to the first detection mode (full keyboard mode) by the setting unit 5, the previously selected chord is determined to be unchanged while the first determining unit 6 determines that it belongs to none of the first chord groups.

Additionally, the configuration of the embodiment includes a discarding unit (not shown: corresponds to the discarding unit of the present invention). In the case of where the first detection mode (full keyboard mode) is operated under the second detection mode (one finger mode or fingered mode), and the chord selected by the second selecting unit 9 is not included in the first chord group, the discarding unit discards the result from the selection.

Furthermore, in the case where the first or the second selecting unit 7 or 9 selects neither of the chords, the automatic accompaniment continues based on the last selected chord.

Figure 7:
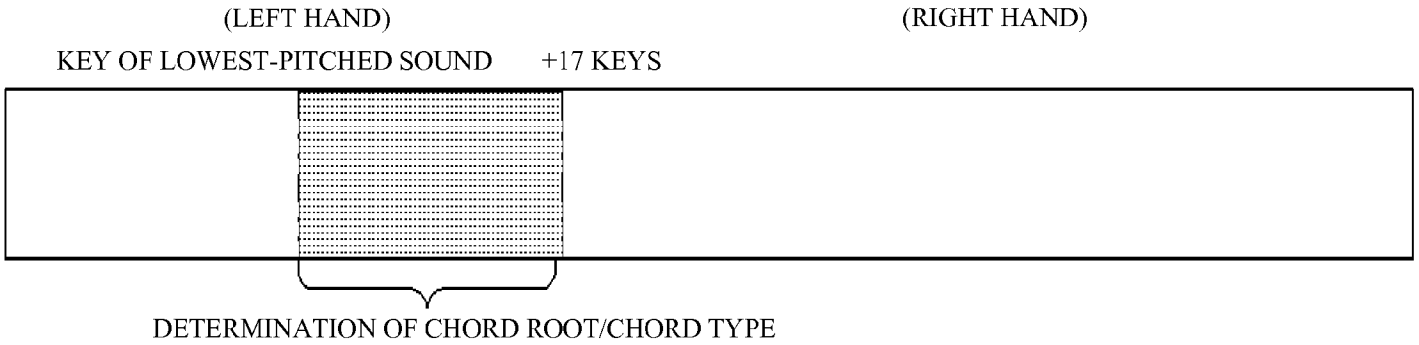
FIG. 7 is an explanatory diagram describing a state of a keyboard portion 114 in the case of whether to perform the fractional chord detection is determined.

According to the configuration of the present invention, as shown in FIG. 7, the lowest-pitched sound on the left hand side is detected. Also, setting the lowest-pitched sound setting as the lower limit (bass detection region) in the first region and, as described above, the 15th key (=N1) as the upper limit in the bass detection region, the fractional chord detection is performed or not is determined based on whether the 3 or more keys are depressed in the region or not.

Figure 12:
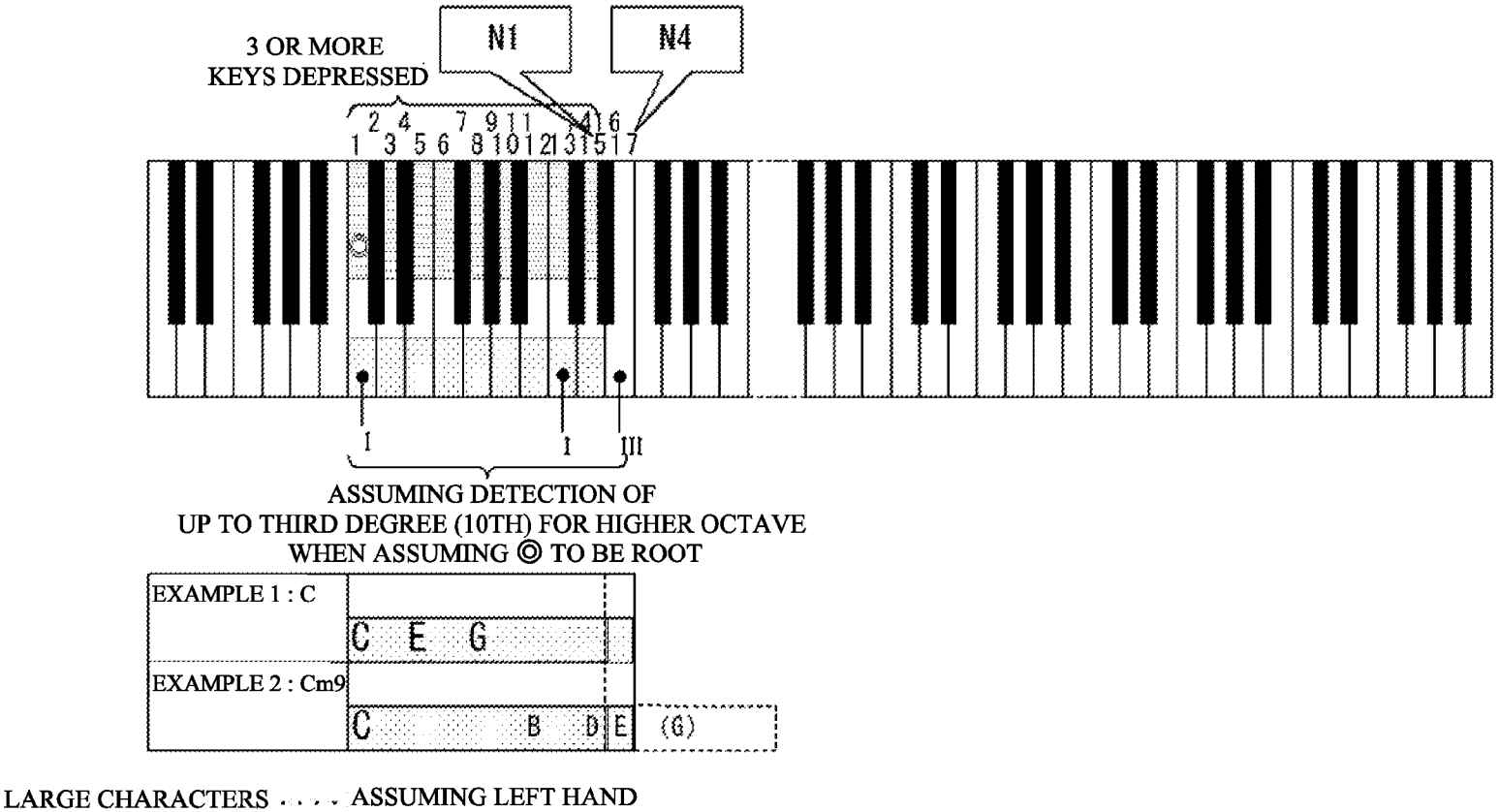
FIG. 12 is an explanatory diagram describing a detailed state of a keyboard portion 114 in the case of whether to perform the fractional chord detection is determined.

According to the configuration of the embodiment, as shown in FIG. 7 and FIG. 12, in the case where there is a detection of 3 or more keys depressed in the above-described bass detection region (first region: in the case of the lowest-pitched sound assumed to be the first degree, 15 keys to 9th), the bass detection is not performed. In other words, fractional chord detection is not performed. In this case, as shown in FIG. 7 and FIG. 12, setting 17 keys (third region from the lowest-pitched sound to a higher sound by a pitch corresponding to the N4 key shown in the following formula 8) from the lowest-pitched sound, which is assumed to be the first degree, to the third degree for the higher octave (10th) as the chord detection region, a chord that is not the fractional chord is detected as the automatic accompaniment chord corresponding to the state of keys depressed in the region. As shown in an example 2: Cm9 of FIG. 12, setting up to 17th sound is due to the determination of Cm9 by using 4 keys of C-B-D-E (in a range of 17 keys) when the representative voicing of C-B-D-E-G (=Cm9) is played.

$$N1 \leq N4 \qquad \text{(Formula 8)}$$

Figure 8:
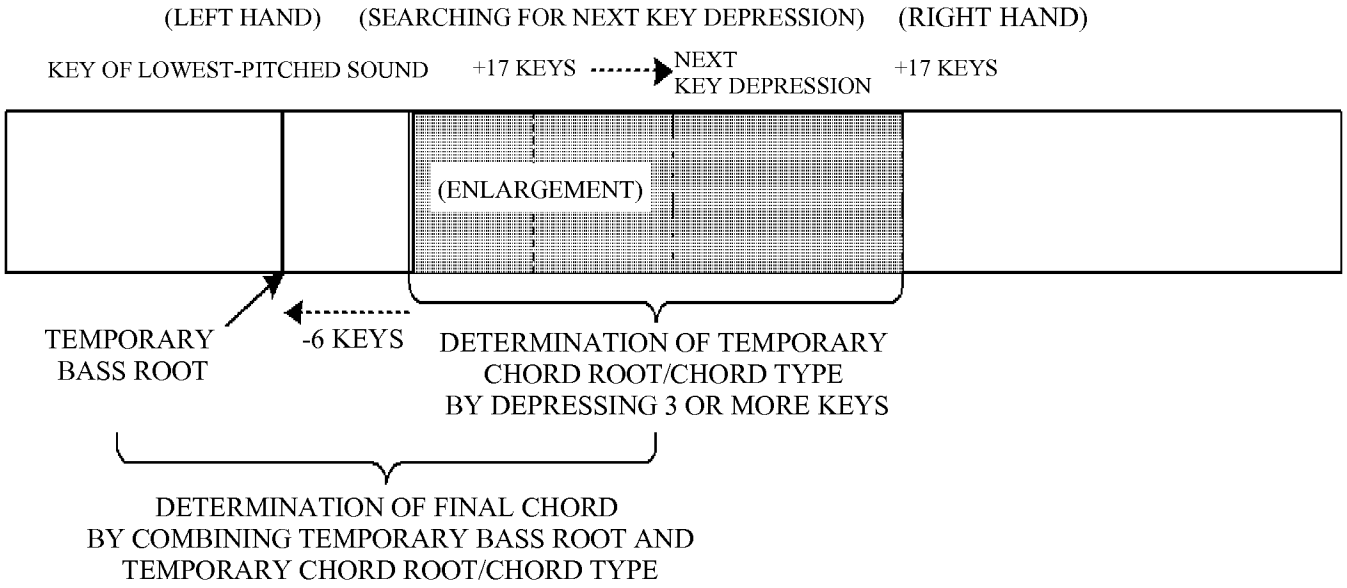
FIG. 8 is an explanatory diagram describing a state of detecting a bass in the case of where the key depression of 2 or fewer keys is detected in a bass detection region.
Figure 13:
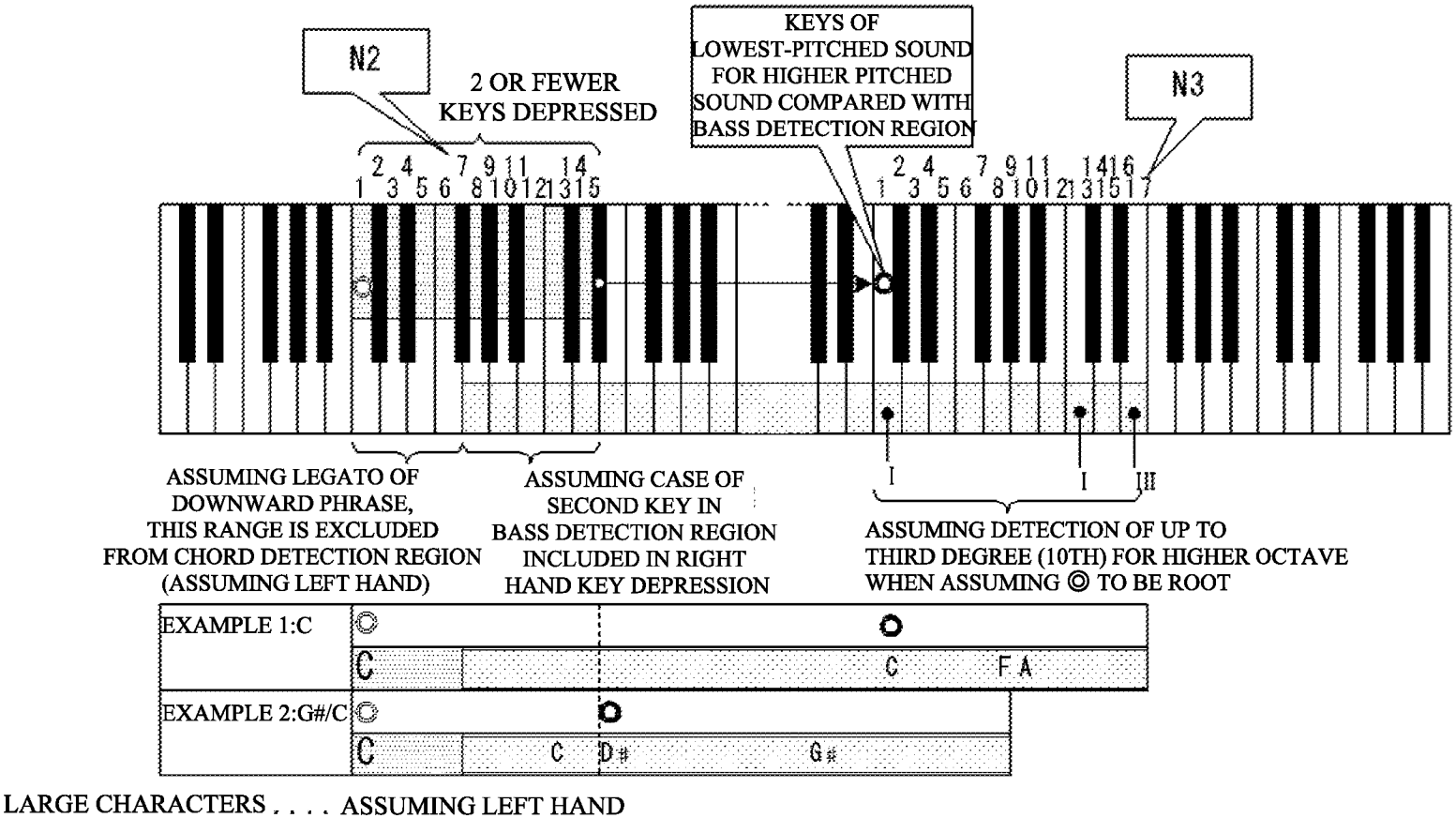
FIG. 13 is an explanatory diagram describing a detailed state of the bass detection performed in the case where the key depression of 2 or fewer keys is detected in the bass detection region.
Figure 14:
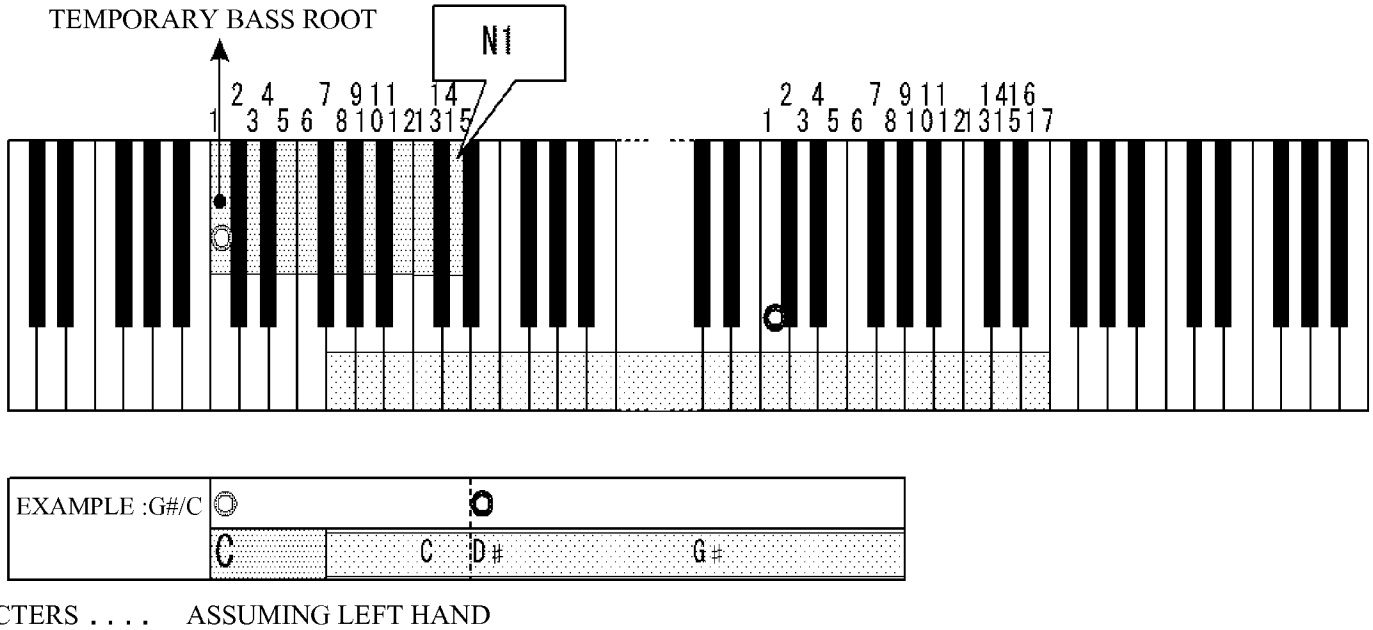
FIG. 14 is an explanatory diagram showing in detail a state in which the final fractional chord is determined in accordance with a chord in the chord detection region on the right hand side region by making the detected pitch name of the lowest-pitched sound into a temporary bass root and performing the fractional chord detection when the key depression of only one key (the lowest-pitched sound) is detected in the bass detection region.

Instead, in the case where there is a detection of 2 or fewer keys depressed in the above-described bass detection region, the bass detection is performed. That is, the fractional chord is detected. In this case, as shown in FIG. 8 and FIG. 13, the lower limit of the chord detection region is assumed to be the 7th key (=N2) from the lowest-pitched sound on the left hand side (key with the gray open circle shown in FIG. 13). Counting from the 7th key, the 17th key (=N3) from the lowest-pitched sound (key with the black open circle shown in FIG. 12), which is one of the higher-pitched sound compared with the bass detection region and is assumed to be the first degree, up to the third degree for the higher octave (10th) is set for the keys between the 7th and 17th to the chord detection region of the fractional chord as the high-pitched sound. Additionally, assuming the legato of the downward phrase in the bass detection region assumed to be the left hand side, the chord detection region assumed to be the right hand side excludes the range from the lowest-pitched sound on the left hand side to the 7th key (=N2).

As described above, the lower limit of the chord detection region is enlarged because it is assumed that the next high-pitched sound to the lowest-pitched sound in the bass detection region is included in the keys depressed by the right hand. For example, when G2-G3-B3-D3 is depressed, the chord detection up to now is ignored since the G2 keyboard is excluded from the chord detection range. However, the enlargement of the range of the chord detection region allows the chord detection.

As described above, the temporary chord root and the temporary chord type are determined when 3 or more keys depressed from the chord detection region and the temporary bass root is detected from the bass detection region, thus the final chord is determined with reference to the data table based on the temporary chords. For example, in the case where the temporary bass root is D and the temporary chord root and the temporary chord type are Bm7 (b5), the final chord is determined as Dm6. Also, in the case where the temporary bass root is E and the temporary chord root and the temporary chord type are C6, the final chord is determined as Am7/E.

In the above-described bass detection region, when one depressed key (the lowest-pitched sound of the key) is detected, as described above, the fractional chord detection is performed. Note that the detected pitch name of the lowest-pitched sound is the temporary bass root. Then, the final fractional chord (bass root/chord) is determined in accordance with the chord in the chord detection region on the right hand side.

Figure 9:
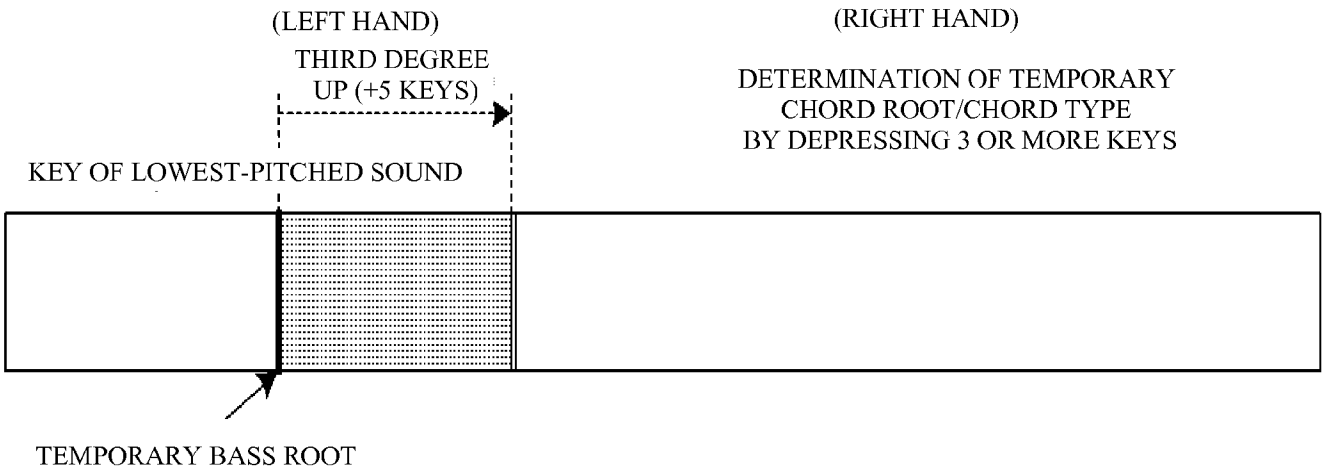
FIG. 9 is an explanatory diagram describing a first key depressed in the bass detection region set to the lowest-pitched sound and setting from the lowest-pitched sound to the third degree up (+5 key) to the bass detection region in the embodiment configuration.

However, in the bass detection region, the keyboard that is desired to be the bass root is not necessarily the lowest-pitched sound by legato and similar method. In this case, it is necessary to determine the bass root according to the distance between the first and the next key depression. In contrast, in the case where the distance between 2 keys is not considered, the chord detection is influenced in the chord detection region side on the right hand side. This may make the detection with the right hand impossible. In that case, as shown in FIG. 9, in the embodiment, the first key depressed in the bass detection region is set to the lowest-pitched sound, and the region from the first key to the third degree up (+5 key) is set to the legato corresponding region for the bass detection.

Figure 10:
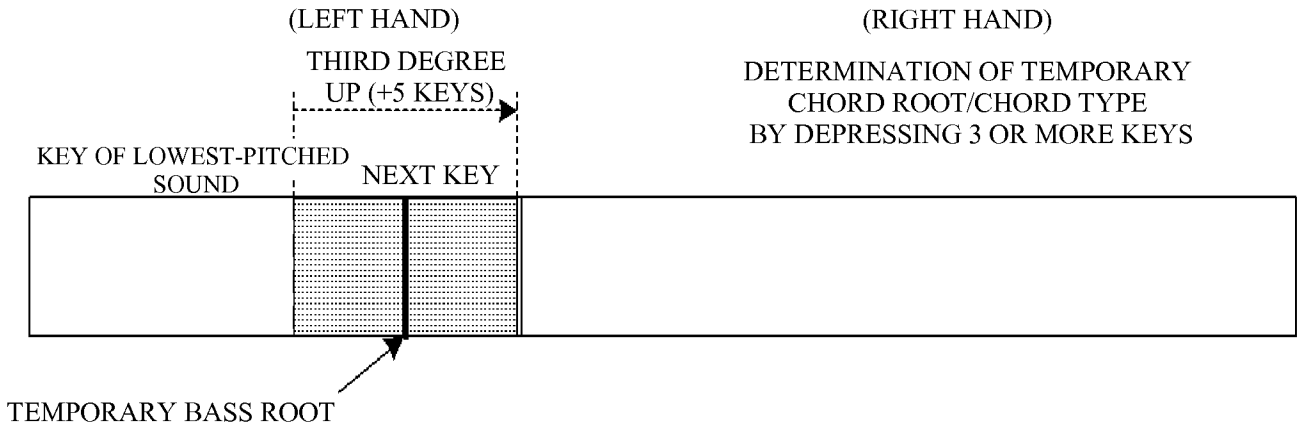
FIG. 10 is an explanatory diagram describing the next key (last key) becoming a temporary bass root when the next key is depressed inside the bass detection region (when the next key is within 4 keys from a previous key)
Figure 15:
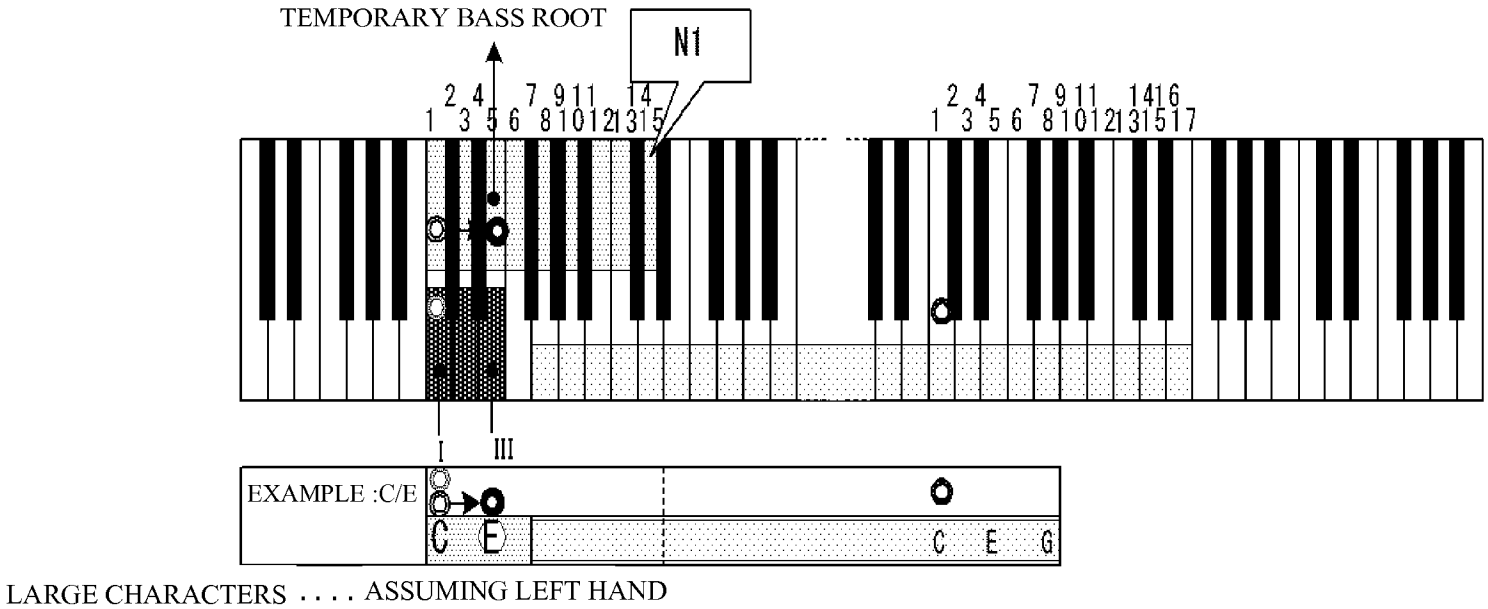
FIG. 15 is an explanatory diagram describing in detail a first key depressed in the bass detection region set to the lowest-pitched sound and setting from the lowest-pitched sound to the third degree up (+5 key) to the bass detection region.
Figure 16:
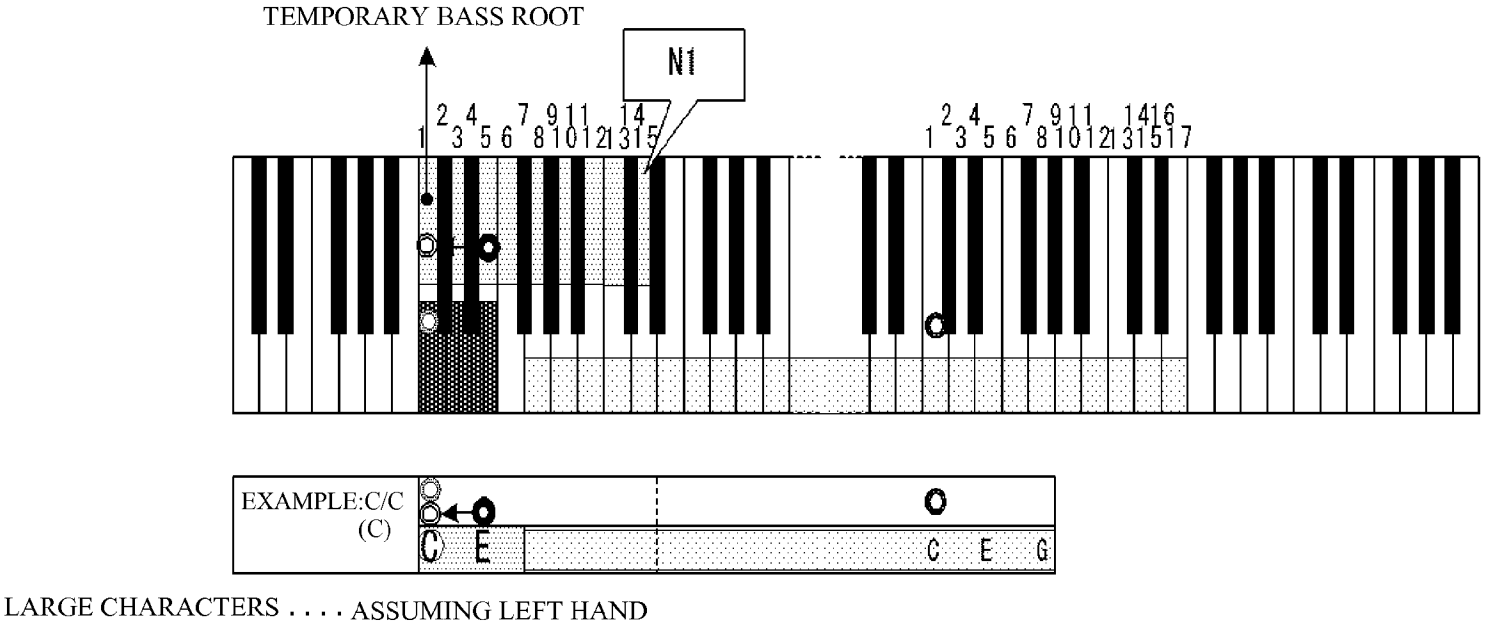
FIG. 16 is an explanatory diagram describing in detail the next key being made into a temporary bass root when the next key (last key) is depressed inside the bass detection region (when the next key is within 4 keys from a previous key)

In the legato corresponding region for bass detection, when the next key is depressed (when the next key is within 4 keys from the previous key), as shown in FIG. 10, the next key (final key) is assumed to be a temporary bass root. The same explanation is shown in FIG. 15 and FIG. 16. FIG. 5 shows the same case with FIG. 9. Also, as shown in FIG. 16, the next key (final key) is the lowest-pitched sound and is assumed to be the temporary bass root.

Then, both the chord detected in the chord detection region and the fractional chord are determined.

Figure 11:
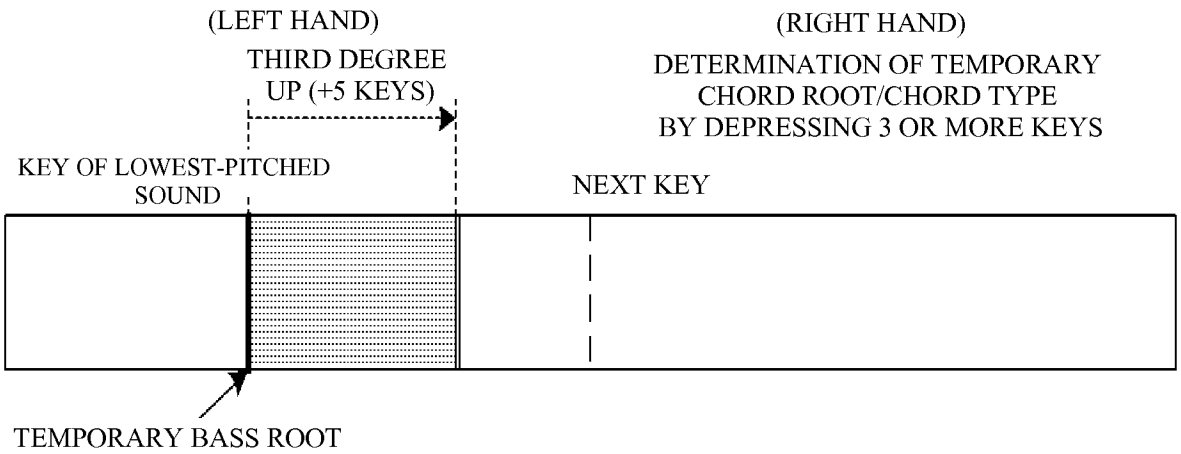
FIG. 11 is an explanatory diagram showing the lowest key becoming a temporary bass root when next key is depressed outside the bass detection region (when the next key is 5 or more keys from a previous key)
Figure 17:
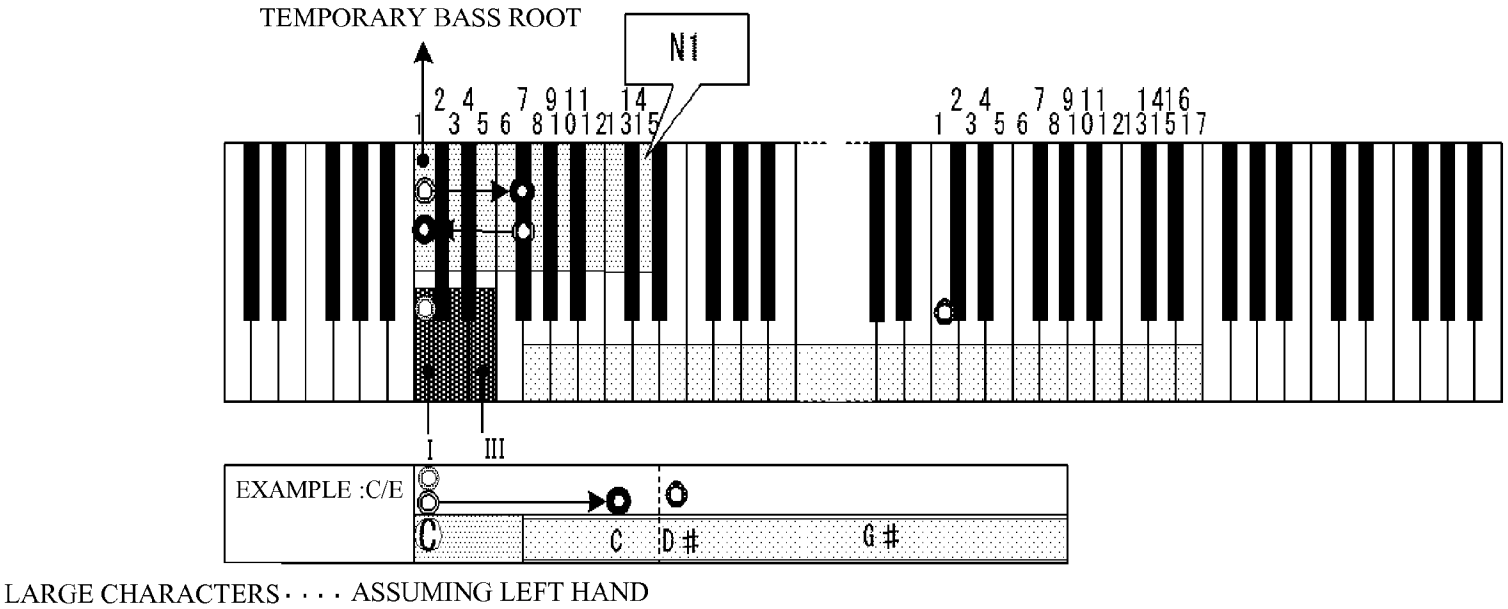
FIG. 17 is an explanatory diagram showing the lowest key being made into a temporary bass root when next key is depressed outside the bass detection region (when the next key is 5 or more keys from a previous key) for both legato in downward and upward phrases.

On the other hand, unlike the case, when the next key is depressed outside the legato corresponding region for bass detection (when the next key is 5 or more keys from the previous key), as shown in FIG. 11, the lowest key is assumed to be the temporary bass root. FIG. 17 indicates the same explanation with FIG. 11. Both legato of downward and upward phrases are shown in FIG. 17. Considering that the key, which is not the lowest-pitched sound, is included in the chord detection region on the right hand side, in the case where the spacing between both keys is larger than the third degree (5 or more keys), the pitch name of the lowest-pitched sound is detected as the temporary bass root.

Then, both the chord detected in the chord detection region and the fractional chord are determined.

The determination of the bass root described above will be described with an explicit example as follows. Here, the first key depressed in the bass detection region is set to the lowest-pitched sound, and the region from the lowest-pitched sound to the third degree up (+5 key) is set to the legato corresponding region for bass detection. The key depression and key release are assumed to be performed in the following order. Also, note that the upper side rather than near the lowest-pitched sound is assumed to be another key depression.

(1) key depression of DO→(2) key depression of MI→(3) key release of DO

In step (1), since the key depression is not within 5 keys from the lowest-pitched sound (DO), DO is the bass root.

In step (2), since another key depression (MI) is within 5 keys from the lowest-pitched sound (DO), MI depressed later is the bass root.

In step (3), since the key depression is not within 5 keys from the lowest-pitched sound (MI), MI is the bass root.

Next, an example of another key depression and key release order will be described.

(4) key depression of DO (5) key depression of SOL (6) key release of DO

In step (4), since the key depression is not within 5 keys from the lowest-pitched sound (DO), DO is the bass root.

In step (5), since another key depression (SOL) is not within 5 keys from the lowest-pitched sound (DO), DO depressed later is the bass root.

In step (6), since the key depression is not within 5 keys from the lowest-pitched sound (SOL), SOL is the bass root.

The difference between the (2) and (5) corresponds to a part described in the claim such as "In the case where the key depression performed with respect to the keyboard is within a range of the predetermined sound from the lowest-pitched sound to the upper side, the pitch name of the depressed key is determined the bass root". The key depression of SOL in (5), which is not within a range of the predetermined sound, does not correspond to the part, thus is not the bass root.

On the other hand, while the fractional chord is temporarily determined, as a result of the chord detected by state of keys depressed in the second region, in the case where the chord root is the same with the bass root, the determiner 2 halts the determination of the fractional chord. Also, the chord detected by the state of the keys depressed in the second region is configured to be determined as the chord performing the automatic accompaniment. This configuration is valid for the case that exits the fractional chord mode and is processed in a manner similar to the case that is not determined by the fractional chord from the start. That is, in the configuration to exit the fractional chord mode, conversely, it is possible to exit the mode once the fractional chord has been determined. Thereafter, in the third region, ordinary chord detection is performed, and automatic accompaniment is performed corresponding to the chord.

Figure 18:
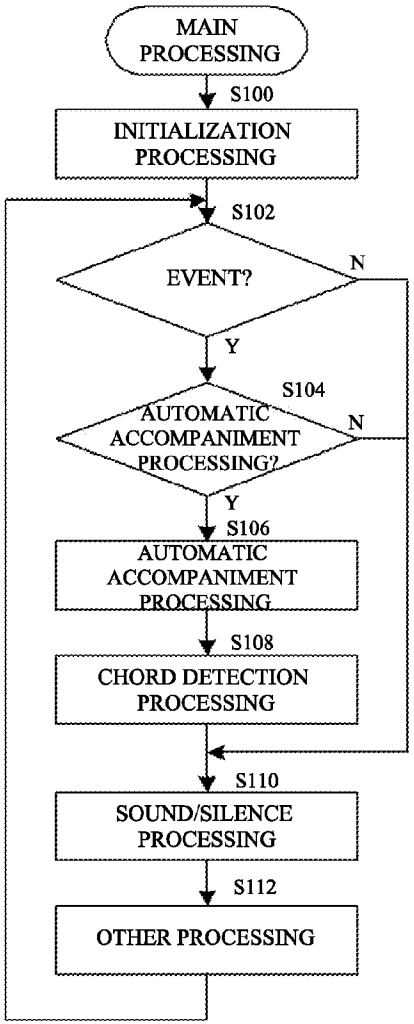
FIG. 18 is a flowchart showing a main flow of the electronic keyboard musical instrument.

FIG. 18 is a flowchart showing a main flow of the electronic keyboard musical instrument. When the electronic keyboard musical instrument is switched ON, the initialization processing is executed (in step S100). Then, it is checked whether or not there is an event (in step S102).

If there are no events (No in step S102), the sound/silence processing proceeds to step S110 described below. In contrast, if there are the events (Yes in step S102), checking whether the automatic accompaniment processing event is performed (in step S104).

When the event is automatic accompaniment processing (Yes in step S104), the automatic accompaniment processing is executed (in step S106). In contrast, if the automatic accompaniment processing is not executed (No in step S104), the sound/silence processing proceeds to step S110 described below.

In the case of the automatic accompaniment processing, the chord detection processing described below is executed (in step S108). Sound/silence processing is executed (in step S110), and another processing is executed (in step S112), then the processing returns to step S102.

Figure 19:
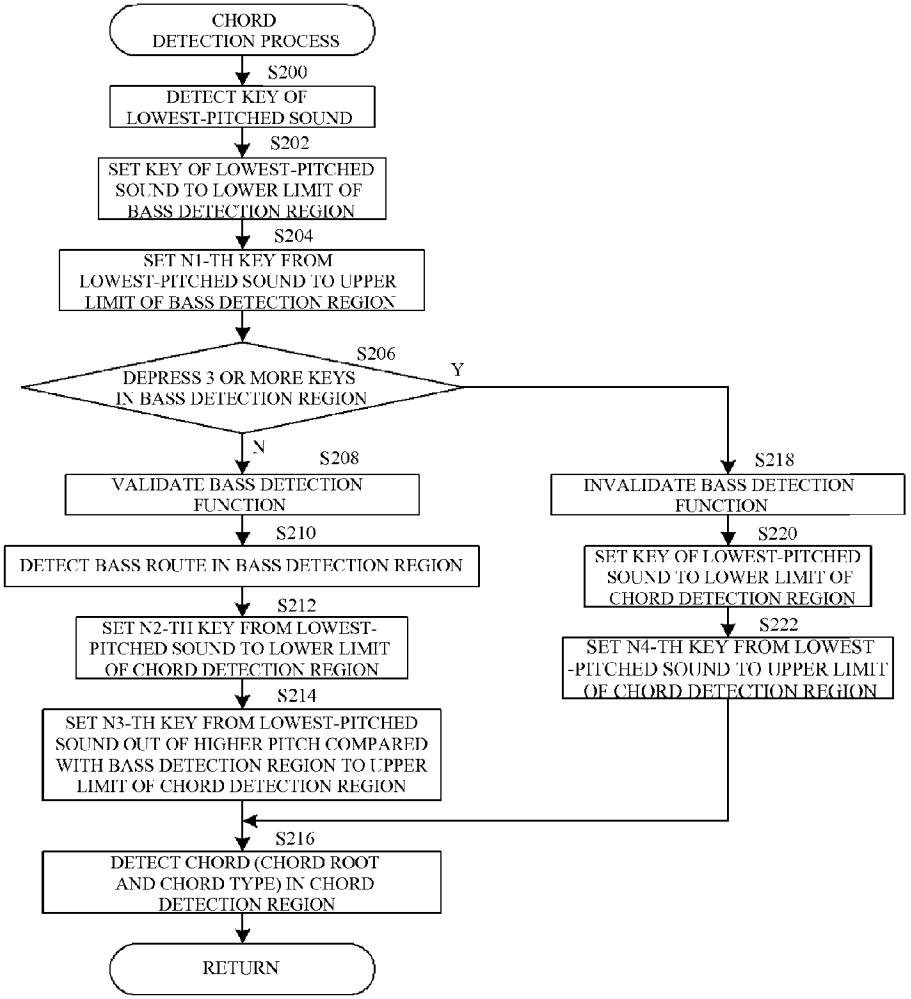
FIG. 19 is a flowchart showing a process flow of the chord detection processing in step S108 shown in FIG. 18 regarding to the configuration of the embodiment.

FIG. 19 is a flowchart showing a process flow of processing the chord detection in step S108 shown in FIG. 18 according to the configuration of the embodiment.

The lowest-pitched sound is detected in the keyboard portion 114 (in step S200). The lowest-pitched sound is set to the lower limit of the bass detection region (in step S202). Additionally, the N1-th key (15th key) from the lowest-pitched sound is set to the upper limit of the bass detection region (in step S204).

Next, it is detected whether or not 3 or more keys have been depressed in the bass detection region (in step S206).

When 3 or more keys have not been depressed in the bass detection region (step S206: N), the bass detection function is enabled, that is, the fractional chord detection results in the execution (in step S208). In such case, the bass root is detected in the bass detection region (in step S210). Then, the N2-th key (7 keys) from the lowest-pitched sound is assumed to be the lower limit of the chord detection region corresponding to the numerator of the fractional chord (in step S212). Also, the N3-th key (17 keys) from the lowest pitch key (the lowest-pitched sound) out of the higher pitch compared with the bass detection region is supposed to be the upper limit of the chord detection region (in step S214).

Furthermore, the chord (chord root and chord type) is detected in the chord detection region (in step S216).

On the other hand, in the step S206, when 3 or more keys have been depressed in the bass detection region (Yes in step S206), the bass detection function is perceived to be ineffective. That is, fractional chord detection does not result in execution (in step S218). In such case, the lowest-pitched sound is perceived to be the lower limit of the chord detection region (in step S220). Also, the N4-th key (17 keys) from the lowest pitch key is perceived to be the upper limit of the chord detection region (in step S214).

Thereafter, the processing proceeds to the step S216, and the chord (chord root and chord type) is detected in chord detection region (in step S216).

Figure 20:
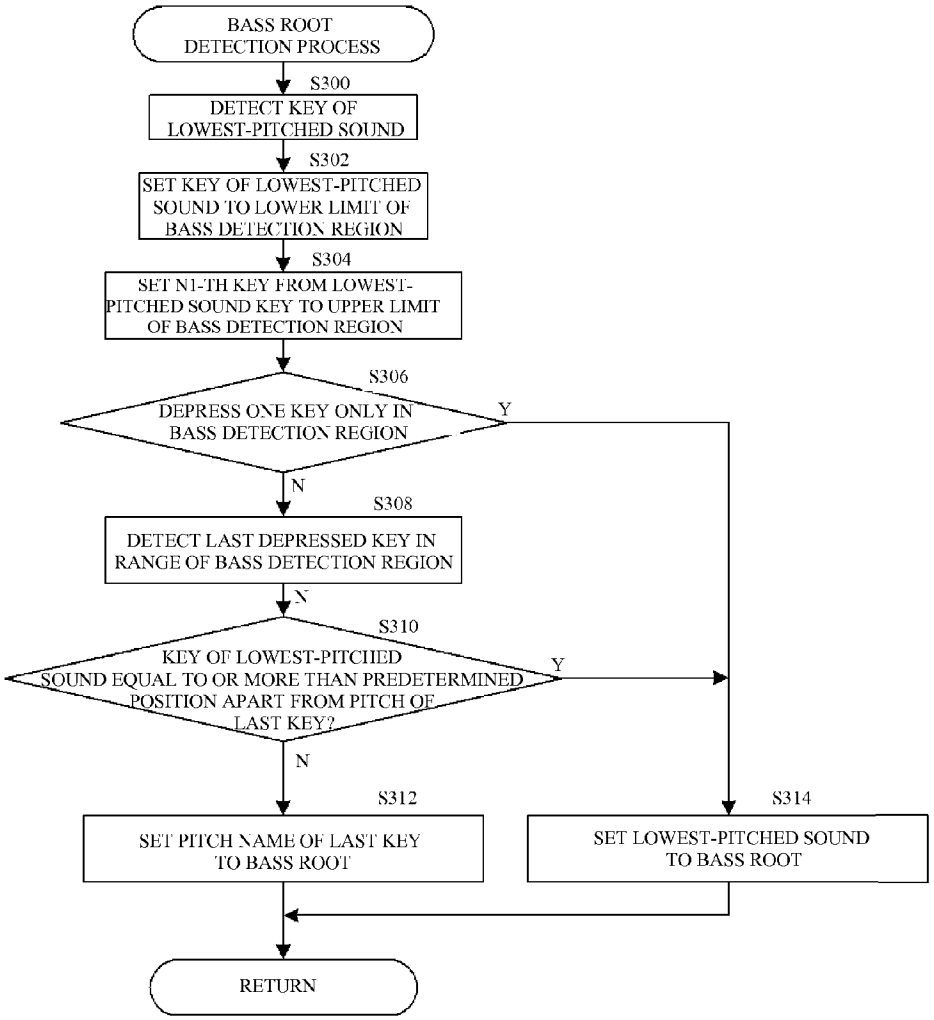
FIG. 20 is a flowchart showing a process flow of the bass root detection processing in step S210 shown in FIG. 19.

FIG. 20 is a flowchart showing a process flow of the bass root detection processing in step S210 shown in FIG. 19

As shown in FIG. 20, the key of the lowest-pitched sound is detected (in step S300). The key of the lowest-pitched sound is perceived to be the lower limit of the bass detection region (in step S302), and the N1-th key (15 keys) from the lowest-pitched sound key is perceived to be the upper limit of the bass detection region (in step S304).

Next, in the bass detection region, whether or not only one key has been depressed is detected (in step S306).

In the bass detection region, if the depressed keys are not only one key (step S306: N), the key depressed last in a range of the bass detection region is detected (in step S308).

Then, it is detected whether or not the key of the lowest-pitched sound is equal to or more than the predetermined value (third degree: 5 keys) apart from the last key (in step S310).

When the lowest-pitched sound is not equal to or more than the predetermined value (third degree: 5 keys) apart from the last key (No in step S310), the pitch name of the last key is perceived to be the bass root (in step S312).

On the other hand, when only one key has been depressed in the bass detection region in the step S306 (Yes in step S306) and the lowest-pitched sound is equal to or more than the predetermined value (third degree: 5 keys) apart from the last key in the step S310 (Yes in step S310), the pitch name of the lowest-pitched sound is perceived to be the bass root (in step S314).

Figure 21:
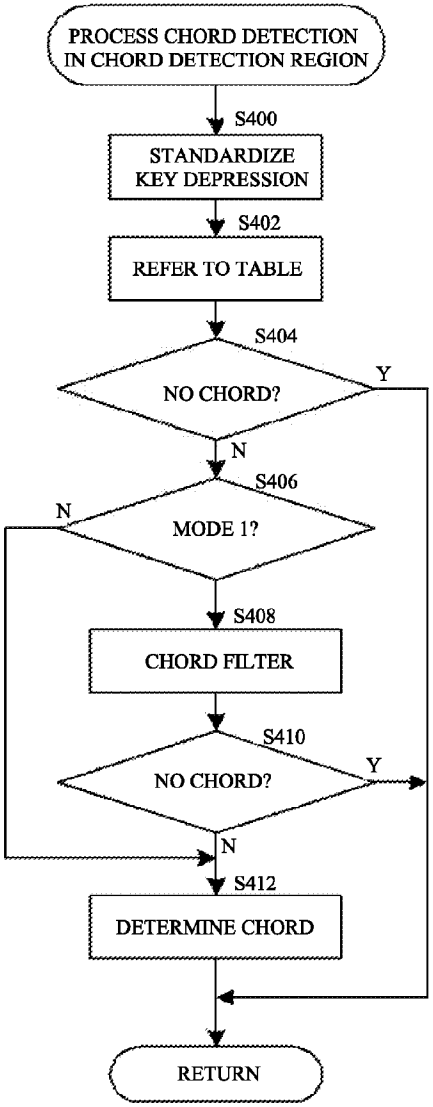
FIG. 21 is a flowchart showing a process flow of the chord detection processing in the chord detection region in step S216 shown in FIG. 19.

FIG. 21 is a flowchart showing a process flow of processing the chord detection in the chord detection region in step S216 shown in FIG. 19.

As shown in FIG. 21, at first, the octave information of all depressed keys within the detection region is removed and standardized (in step S400). That is, 12 bits of pitch name information (ON/OFF information of C, C#, D, D#, . . . B) is made.

The standardized state is referred with the table as 12 bits of address (in step S402).

Whether or not there are the chords in the table, that is, whether or not there are no chords is determined (in step S404).

In step S404, when no chords are detected (Yes in step S404), the processing proceeds to step S110 in FIG. 18. In contrast, when chords are detected (No in step S404), it is detected whether or not it is the first detection mode (full keyboard mode) (in step S406).

When it is not the first detection mode (full keyboard mode) (No in step S406), that is, when it is the second detection mode (one finger mode or fingered mode), the processing proceeds to step S412 described below.

In contrast, when it is the first detection mode (full keyboard mode) (Yes in step S406), the chord that should not be determined is discarded by using the discarding unit (chord filter) (becoming no chords) (in step S408).

Then, the output of the discarding unit (chord filter) determines whether or not there is no chords (in step S410).

When no chords are detected in step S410 (Yes in step S410), the processing proceeds to step S110 in FIG. 18. In contrast, when chords are detected (No in step S410), the chord is determined with respect to the remaining chord (in step S412). That is, for example, the determined chord is stored into the chord register (disposed to an arbitrary address into the RAM 112). The automatic accompaniment apparatus performs automatic accompaniment based on the chord stored in the chord register. In the case where no chords are detected in step S404 or S410 and new storage is not written over in the chord register, the automatic accompaniment apparatus continues the automatic accompaniment in accordance with the last stored chord.

With the configuration of the fractional chord determination apparatus according to the embodiment of the present invention described above, the determiner 2 determines whether or not the fractional chord is to be determined according to the number of depressed keys (whether or not 3 or more keys) in the bass detection region as the first region. When the determiner 2 has determined that the fractional chord is to be determined, the second setting portion 3 sets the chord detection region as the second region corresponding to the lower limit sound set as the depressed keys of the lowest-pitched sound and the upper limit sound set as the depressed keys of the lowest-pitched sound among the depressed keys for the higher pitched sound compared with the bass detection region. Also, the bass root is determined by the state of the depressed keys in the bass detection region, and each chord root, which is different from the bass root, is determined by the state of the depressed keys in the chord detection region, thus the fractional chord is automatically detected. As a result, the fractional chord determination apparatus is configured to enable automatic accompaniment that corresponds to the fractional chord.

Additionally, the bass root is the pitch name corresponding to the depressed key in the bass detection region, and within the range of the predetermined sound (third degree: 5 keys) on the upper side from the depressed key of the lowest-pitched sound on the keyboard, the pitch name of the last depressed key is determined to be the bass root. According to this configuration, in the case where the bass key depression on the bass root side has been played on the legato side, the pitch name of the last depressed key in the legato is determined to the bass root. Thus, also in the case where the keyboard on the upper side from the lowest-pitched sound has been depressed, the configuration enables to determine the bass root before releasing the keyboard on the lowest-pitched sound and to change the bass root to the timing which the performer desires more. Furthermore, when the key depressed later has been outside the range, the pitch name of the lowest-pitched sound is determined to the bass root, and the configuration enables to extend the chord detection range of another chord detection region of the fractional chord. That is, if the finger which is playing the chord side of another chord detection region approaches the bass root side, it is possible to be erroneously determined to a part of the chord on the bass root side. However, regarding the case where the key depressed later has been outside the range, the pitch name of the lowest-pitched sound has been determined to the bass root. Thus, even if the chord detection range of another chord detection region of the fractional chord approaches the bass root side, the configuration has an advantage of eliminating the erroneous determination.

Furthermore, when the determiner 2 has determined not to be set to the fractional chord, the third region is set to the upper side of the N4 key (17 keys) from the minimum pitch. The chord other than the fractional chord is configured to determine to the chord performing the automatic accompaniment corresponding to the state of key depressed key in the third region. Therefore, also in the configuration of the fractional chord determination apparatus, since the determination to the fractional chord is not made, the normal chord detection is executed in the third region, and the automatic accompaniment is performed corresponding to the chord.

Additionally, by being configured to exit the fractional chord mode, conversely, the configuration enables an exit the mode after the fractional chord has been determined. After that, the normal chord detection is performed in the third region, the automatic accompaniment is performed corresponding to the chord.

With the automatic accompaniment apparatus of the electronic keyboard musical instrument according to the embodiment, the number of chords belonging to the first chord group is decreased to less than the number of chords belonging to the second chord group. In the case of the first detection mode (full keyboard mode), when the first determining unit 6 determines that it is not any of the first chord group, the first determining unit 6 determines it as the previously selected chord. Even if the chord detection is performed point by point with respect to the movement of the melody, as described above, the number of chords which is actually detected is reduced to less than the second detection mode (one finger or fingered mode). Therefore, the number of accompaniment changes decreases, and the accompaniment playback is stabilized.

In the configuration, after the first detection mode (full keyboard mode) has detected the chord detected by the second detection mode (one finger mode or fingered mode), when the chord selected by the second selecting unit 9 is not included in any of the first chord group, the result of the selection is discarded by the discarding unit (chord filter). That is, by not having a chord, the number of chords which is actually detected is reduced, and the number of accompaniment changes decreases. Therefore, the accompaniment playback is stabilized.

When the first or the second selecting unit 7 or 9 does not select either chord, the automatic accompaniment continues based on the last chord selected. As a result, the accompaniment playback is further stabilized.

FIG. 22 shows an example in the case where whether or not the number of detected chords is reduced when the first detection mode (full keyboard mode) is performed.

In the example, the result of both examples in the case of playing the CM7 chord (C3, E3, G3, B3) with the left hand, and the melody (G4→A4→B4→C5→D5) with the right hand is shown.

In the example, the accompaniment is changed 3 times in chord detection (1). That is, chord detection (1) temporarily mutes the current sound, and adjusts the sound again to a pitch to match the new detection chord. Since the accompaniment arrangement deviates from the arrangement of the original accompaniment when the pitch of the sound lengthened and the pitch is changed by a degree of change corresponding to the melody sound, for example, like a whole note or similar note, the image of the accompaniment and the sense of rhythm are no longer stabilized. Thus, the chord detection (1) is not preferred.

In contrast, with the chord detection (2) of the configuration according to the embodiment, by decreasing the number of chords detected, the accompaniment change becomes 1 time, and the accompaniment playback is stabilized. When the melody sound is A4, the CM7 (13) chord is not detected. However, in the case where the melody and accompaniment are listened to as a whole, the melody sound A4 is sufficient for the vibrancy of the A sound, and there is no particular problem.

Thus, in the case of the first detection mode (full keyboard mode), use of the configuration of the embodiment with the reduced number of chords detected, even if the chord detection is performed point by point with respect to the movement of the melody, as described above, the number of chords actually detected is reduced. Therefore, the number of accompaniment changes decreases, and the accompaniment playback is stabilized.

Also, the automatic accompaniment apparatus of the electronic keyboard musical instrument according to the present invention and the fractional chord determination apparatus used in the apparatus are not limited only to the above-described diagram example. It is of course possible that various modifications may be made within the scope without departing from the spirit of the present invention.

INDUSTRIAL APPLICABILITY

The configuration of the apparatus of the present invention can be applied to the configuration which connects the electronic keyboard musical instrument and the keyboard to PC, and can be used as the musical instrument, and it is possible to produce the aforementioned effects in such case.

The entire disclosures of Japanese Patent Applications No. 2012-108818, filed on May 10, 2012 and No. 2012-115924, filed on May 21, 2012, each including specification, claims, drawings and summary, is incorporated herein by reference in its entirety.

What is claimed is:

1. An automatic accompaniment apparatus for an electronic keyboard musical instrument for performing chord detection based on a state of a key depressed in a region combining at least an accompaniment region and a melody playing region in a keyboard with a plurality of keys, so as to perform automatic accompaniment based on a detected chord, the automatic accompaniment apparatus, comprising:

setting unit configured to set a detection mode by switching between a first detection mode and a second detection mode, the first detection mode setting a whole region combining the accompaniment region and the melody playing region to a detected object of the chord detection, the second detection mode setting a part of the accompaniment region to a detected object of the chord detection;

first determining unit configured to determine whether or not a state of a key depressed in a region set to the detected object corresponds to any chord in a first chord group in a case where the first detection mode is set by the setting unit;

first selecting unit configured to select a corresponding chord in the first chord group in a case where the first determining unit determines that the state of the key depressed corresponds to one chord in the first chord group;

second determining unit configured to determine whether or not the state of the key depressed in the region set to the detected object corresponds to any chord in a second chord group in a case where the second detection mode is set by the setting unit;

second selecting unit configured to select a corresponding chord in the second chord group in a case where the second determining unit determines that the state of the key depressed corresponds to one chord in the second chord group; and automatic accompaniment unit configured to perform automatic accompaniment based on a chord selected by the first selecting unit or the second selecting unit, wherein in a case where the number of chords belonging to the first chord group is set to be fewer than the number of chords belonging to the second chord group, and the setting unit sets the first detection mode, a previously selected chord is continuously determined when the first determining unit determines that the state of the key depressed is not any chord in the first chord group.

2. The automatic accompaniment apparatus for the electronic keyboard musical instrument according to claim 1, wherein the first determining unit determines the second chord group and selects a corresponding chord in the second chord group, and the automatic accompaniment apparatus further comprises a discarding unit configured to discard a result of the selection in a case where the selected chord is not included in the first chord group.

3. The automatic accompaniment apparatus for the electronic keyboard musical instrument according to claim 1, wherein in a case where the first selecting unit or the second selecting unit does not select any chord, the automatic accompaniment continues based on a last chord selected.

4. A fractional chord determination apparatus for determining a fractional chord corresponding to a depressed key, by setting a first region to detect a bass root of the fractional chord on a keyboard with a plurality of keys and a second region to detect a chord with a root that is different from the bass root on the keyboard, so as to determine the fractional chord by detecting the bass root and the chord corresponding to a state of a key depressed in each region, the fractional chord determination apparatus comprising:

first setting unit configured to set the first region corresponding to a lowest-pitched sound by a key depressed on the keyboard;

determining unit configured to determine whether the fractional chord is to be determined corresponding to the number of keys depressed in the first region;

second setting unit configured to set a region between: a lower limit sound set corresponding to a lowest-pitched sound by the key depressed on the keyboard; and an upper limit sound set corresponding to a lowest-pitched sound by the key depressed on a keyboard of a higher sound than a sound in the first region, to the second region when the determining unit determines that the fractional chord is to be determined; and control unit configured to respectively determine: a bass root based on the state of the key depressed in the first region, and a chord with a root that is different from the bass root based on the state of the key depressed in the second region, and for performing automatic accompaniment corresponding to the fractional chord.

5. The fractional chord determination apparatus according to claim 4, wherein the control unit determines a pitch name corresponding to the depressed key in the first region as the bass root in a case where a last depressed key is in a predetermined sound range from a lowest-pitched sound by the key depressed on the keyboard toward an upper side, and the control unit determines a pitch name of the lowest-pitched sound as the bass route root in a case where the key depressed is out of the range.

6. The fractional chord determination apparatus according to claim 4, wherein in a case where the determining unit determines that the fractional chord is not determined, the control unit sets a third region between the lowest-pitched sound and a sound higher than the lowest-pitched sound by a pitch corresponding to the N4 key shown in the following formula 12 and determines a chord that is not a fractional chord as a chord for performing the automatic accompaniment corresponding to a state of keys depressed in the third region $$N1<N4 \quad \text{(Formula 12).}$$

7. The fractional chord determination apparatus according to claim 4, wherein in a case where a chord detection based on a state of a key depressed in the second region results in a root of this chord that coincides with the bass root, fractional chord determination is stopped and the chord detected based on the state of key depressed in the second region is determined as a code for performing the automatic accompaniment.

8. A fractional chord determination apparatus for determining a fractional chord corresponding to a depressed key, by setting a first region to detect a bass root of the fractional chord on a keyboard with a plurality of keys and a second region to detect a chord with a root that is different from the bass root on the keyboard, so as to determine the fractional chord by detecting the bass root and the chord corresponding to a state of a key depressed in each region, the fractional chord determination apparatus, comprising:

first setting unit configured to set the first region corresponding to a lowest-pitched sound by a key depressed on the keyboard to a sound between the lowest-pitched sound and a sound higher than the lowest-pitched sound by a pitch corresponding to N1 key shown in the following formula 9;

determining unit configured to determine that the fractional chord is to be determined in a case where the number of depressions on the keyboard in the first region is equal to or less than two, and for determining that the fractional chord is not to be determined in a case where the number of depressions is equal to or more than three;

second setting unit configured to set a region between: a lower limit sound that is a sound higher than the lowest-pitched sound upon a key depressed on the keyboard by a pitch corresponding to the N2 key shown in the following formula 10; and an upper limit sound that is a sound higher than the lowest-pitched sound upon a key depressed on a keyboard of a higher sound than a sound in the first region by a pitch corresponding to the N3 key shown in the following formula 11, to the second region when the determining unit determines that the fractional chord is to be determined; and control unit configured to respectively determine: a bass root based on a state of depressed key in the first region, and a chord with a root that is different from the bass root based on a state of key depressed in the second region, and for performing automatic accompaniment corresponding to the fractional chord $$1<N1 \quad \text{(Formula 9)}$$

$$1<N2 \quad \text{(Formula 10)}$$

$$1<N3 \quad \text{(Formula 11).}$$

* * * * *